US012747536B2

(12) United States Patent
Shogren et al.

(10) Patent No.: US 12,747,536 B2
(45) Date of Patent: Sep. 29, 2026

(54) MOISTURE/OIL RESISTANT COMPOSITE MATERIALS

(71) Applicant: WORLD CENTRIC, Rohnert Park, CA (US)

(72) Inventors: Randal L. Shogren, Columbia Falls, MT (US); San Hein, Rohnert Park, CA (US); Xing Jin, Albany, CA (US)

(73) Assignee: World Centric, Rohnert Park, CA (US)

( * ) Notice: Subject to any disclaimer, the term of this patent is extended or adjusted under 35 U.S.C. 154(b) by 66 days.

(21) Appl. No.: 18/925,969

(22) Filed: Oct. 24, 2024

(65) Prior Publication Data

US 2025/0052006 A1 Feb. 13, 2025

Related U.S. Application Data

(62) Division of application No. 17/880,219, filed on Aug. 3, 2022, now Pat. No. 12,157,976.

(51) Int. Cl.

| | |
|---|---|
| ***D21H 11/00*** | (2006.01) |
| ***D21H 17/15*** | (2006.01) |
| ***D21H 17/24*** | (2006.01) |
| ***D21H 17/65*** | (2006.01) |
| ***D21H 25/00*** | (2006.01) |
| ***D21H 25/04*** | (2006.01) |

(Continued)

(52) U.S. Cl.

CPC ..... *D21H 11/00* (2013.01); *D21H 17/15* (2013.01); *D21H 17/24* (2013.01); *D21H 17/65* (2013.01); *D21H 25/005* (2013.01); *D21H 25/04* (2013.01); *D21C 9/002* (2013.01); *D21J 3/00* (2013.01)

(58) Field of Classification Search

CPC ..... D21H 11/00; D21H 17/15; D21H 17/24; D21H 17/65; D21H 25/005; D21H 25/04; D21C 9/002; D21J 3/00

See application file for complete search history.

(56) References Cited

U.S. PATENT DOCUMENTS

| | | | | |
|---|---|---|---|---|
| 12,157,976 | B2 * | 12/2024 | Shogren | D21H 11/00 |
| 2024/0052571 | A1 * | 2/2024 | Shogren | D21H 11/00 |
| 2025/0052006 | A1 * | 2/2025 | Shogren | D21H 11/00 |

FOREIGN PATENT DOCUMENTS

| | | | |
|---|---|---|---|
| CA | 1330916 | C | 7/1994 |
| CN | 1558028 | A | 12/2004 |
| CN | 111636238 | A | 9/2020 |

(Continued)

OTHER PUBLICATIONS

Extended European Search Report for European Application No. 23850738.8, dated Jun. 17, 2026, 13 Pages.

*Primary Examiner* — Jose A Fortuna
(74) *Attorney, Agent, or Firm* — Meunier Carlin & Curfman LLC

(57) ABSTRACT

Described are oil and water-resistant compositions and methods of making and using such compositions. The compositions can be used to prepare oil and water-resistant articles of manufacturing. Oil and water-resistant compositions can include a fiber, a polysaccharide, an acid, and water; wherein the composition is water and oil resistant when compressed and heated. Other oil and water-resistant compositions can include a fiber, a blocking agent such as a fatty acid, a metal salt of a fatty acid, or combinations thereof, and water, wherein the composition is water and oil resistant when compressed and heated.

16 Claims, 6 Drawing Sheets

(51) Int. Cl.
*D21C 9/00* (2006.01)
*D21J 3/00* (2006.01)

(56) References Cited

FOREIGN PATENT DOCUMENTS

| | | | | |
|---|---|---|---|---|
| CN | 113373738 | A | 9/2021 | |
| WO | WO-2024030534 | A2 * | 2/2024 | ..... D21H 11/00 |

* cited by examiner

MOISTURE/OIL RESISTANT COMPOSITE MATERIALS

BACKGROUND

Single-use plastic packaging made from petroleum-derived polymers like polystyrene, polypropylene, and polyethylene have become problematic due to littering, persistence in the environment, difficulty with recycling, declining fossil resources, and ingestion and accumulation in animals. In contrast, cellulose-based food packaging is becoming increasingly popular due to its biodegradability, compostability, and sustainable production from plants. Examples of cellulose fiber food serving containers include cups, plates, clamshells, paper wraps, etc. However, penetration of such containers by oil and grease in foods, and their transfer onto hands, clothing, and tabletops is a problem. Therefore, these articles are usually coated with materials which block water and oil absorption such as polyethylene, petroleum waxes, acrylics, poly (ethylene-co-vinyl alcohol), polyvinylidene chloride, or polyfluoroalkyl substances (PFAS). None of these are biodegradable and the adherence of the polymers to the paper substrate make recycling difficult. PFAS in particular, may cause cancer and other chronic health conditions. Starch coatings are effective grease barriers but are normally subject to disruption or to dissolving in cold or hot water which diminishes their barrier properties.

Accordingly, there is a need for biodegradable or compostable hot water and oil resistant uncoated composite sheets manufactured without the use of fluorochemicals. The compositions and methods disclosed herein address these and other needs.

SUMMARY

Provided herein is a fiber matrix including a pulped fiber, a polysaccharide, and a fatty acid or a salt, ester, amide, derivative thereof, or any combination thereof, an acid, or any combination thereof. In some embodiments, the fiber matrix can further include an internal sizing agent such as an alkyl ketene dimer; a filler, or any combination thereof.

Provided herein is also a fiber matrix including a pulped fiber and a fatty acid or salt, ester, amide, derivative thereof, or any combination thereof distributed within the fiber matrix. In some embodiments, the compositions can further include an internal sizing agent such as an alkyl ketene dimer; a polysaccharide; a surfactant; a filler; an acid, or any combination thereof.

In some embodiments, the fiber can include a cellulosic fiber. In some embodiments, the fiber matrix is water and oil resistant when compressed and heated.

Described herein are methods for preparing the fiber matrix described herein, the method including blending pulped fiber, polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the fiber matrix. In some embodiments, the methods can further include blending an internal sizing agent, a filler, or any combination thereof with the pulped fiber, water, polysaccharide, and the fatty acid or salt, ester, amide, derivative thereof, or any combination thereof, an acid, or any combination thereof to create the slurry.

Described herein are also methods for preparing a fiber matrix, the method including blending pulped fiber, fatty acid or salt, ester, amide, derivative thereof, or any combination thereof, and water to create a slurry; casting the slurry to a wet mat of product shape; and compressing and heating the wet mat to remove water to form a fiber matrix. In some embodiments, the methods can further include blending an acid, an internal sizing agent, a filler, a polysaccharide, a surfactant, or any combination thereof with the pulped fiber, water, fatty acid or salt, ester, amide, derivative thereof, or any combination thereof to create the slurry.

In some embodiments, the fiber matrix described herein is oil and water resistant.

Described are also article of manufacture made using the fiber matrix described herein and methods described herein. The article of manufacture can include a food container such as a box, a cup, a clamshell, a plate, a bowl, a tray, a carton, an envelope, a sack, a bag, a baggie, a liner, a partition, a wrapper, a film, sheet, or a cushioning material.

The details of one or more embodiments of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Figure 1:
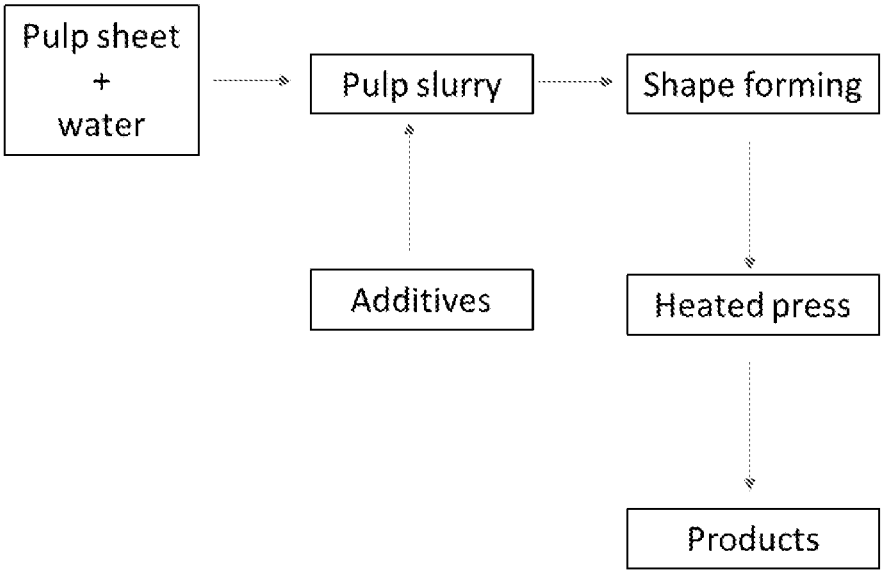
FIG. 1 illustrates a scheme for preparing an oil and water-resistant article of manufacture.
Figure 2:
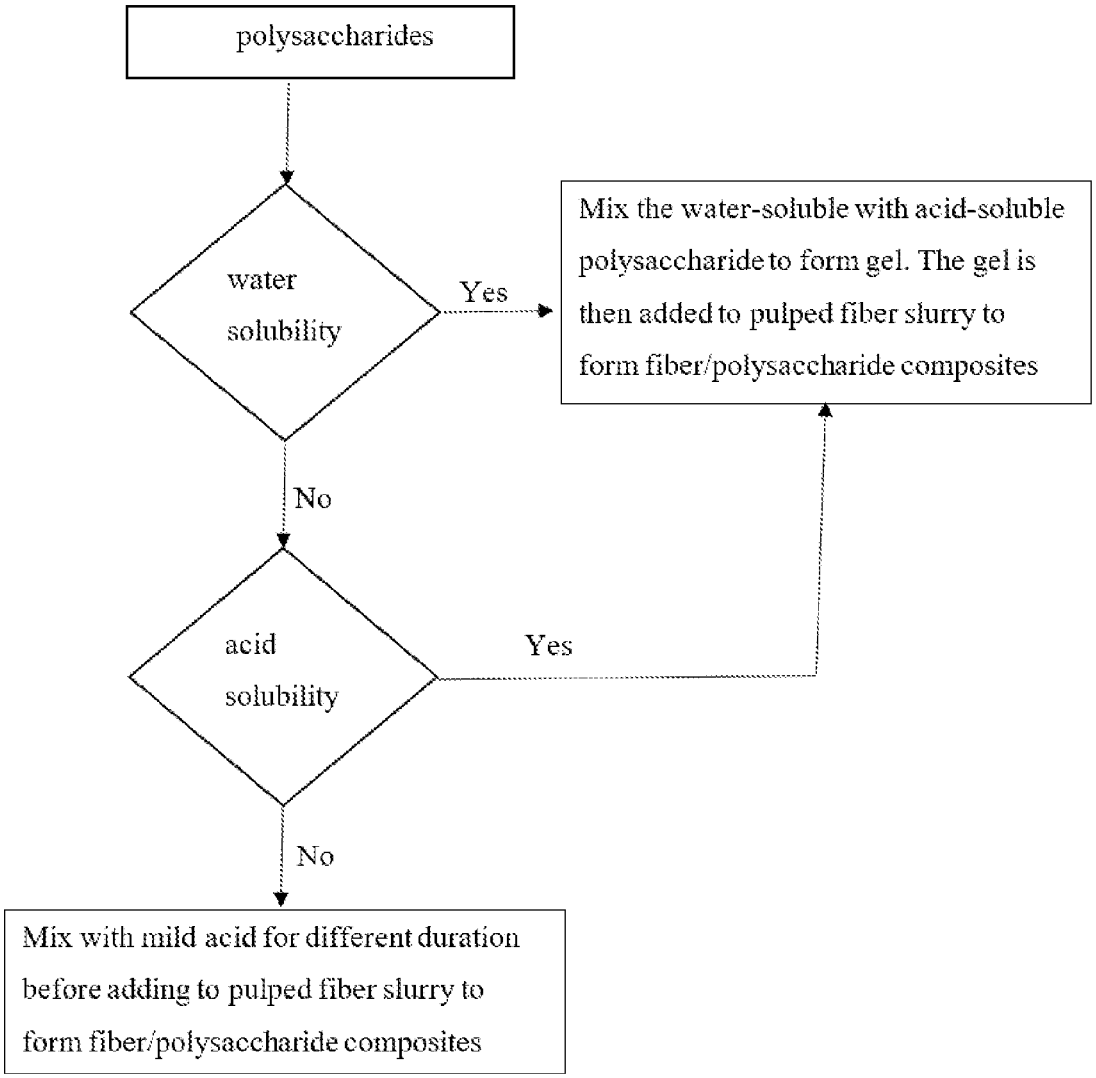
FIG. 2 shows a scheme for preparing an exemplary oil and water-resistant composite material.
Figure 3:
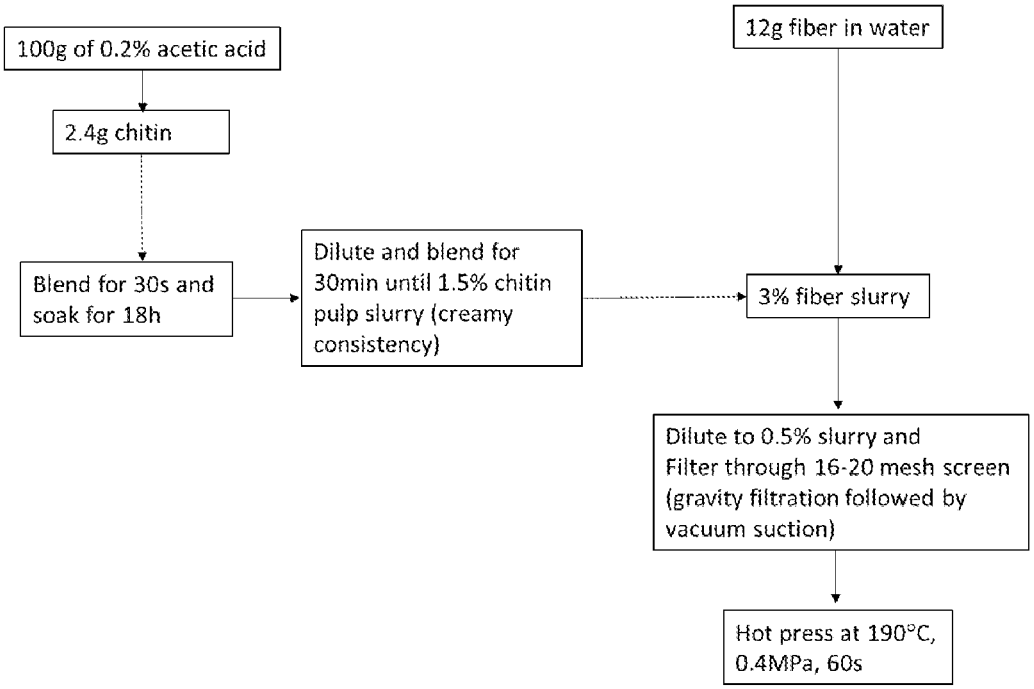
FIG. 3 shows the steps for preparing an exemplary oil and water-resistant composite material with a water-insoluble acid-insoluble polysaccharide.
Figure 4:
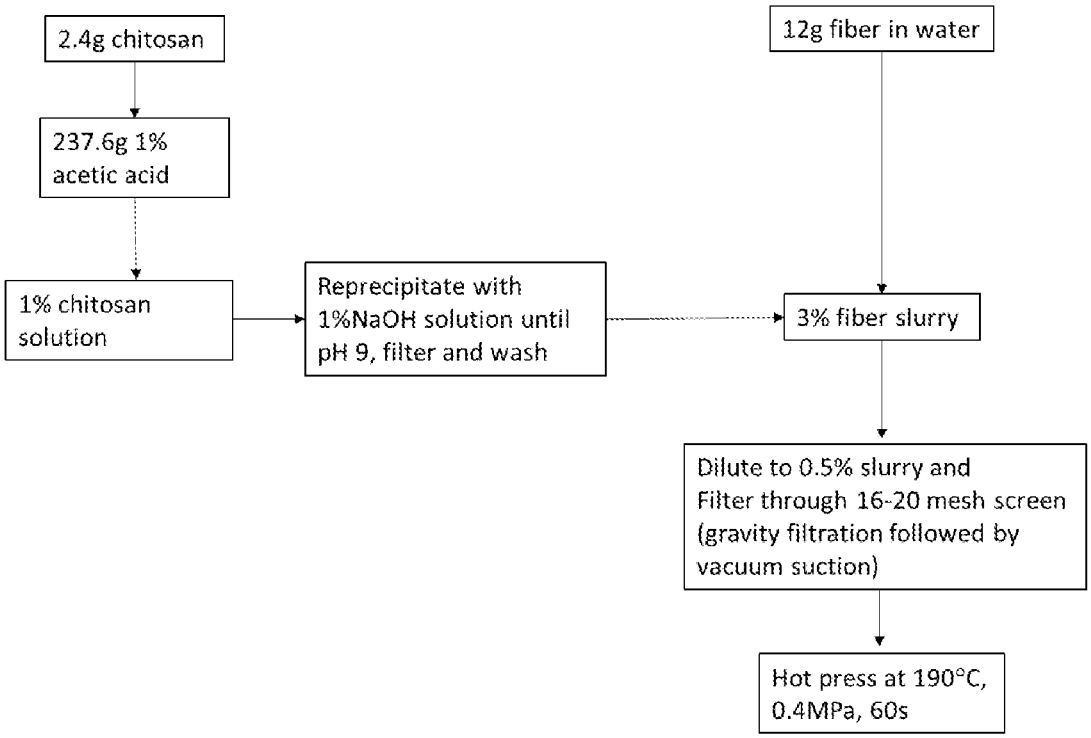
FIG. 4 shows the steps for preparing an exemplary oil and water-resistant composite material with a water-insoluble acid-soluble polysaccharide.
Figure 5:
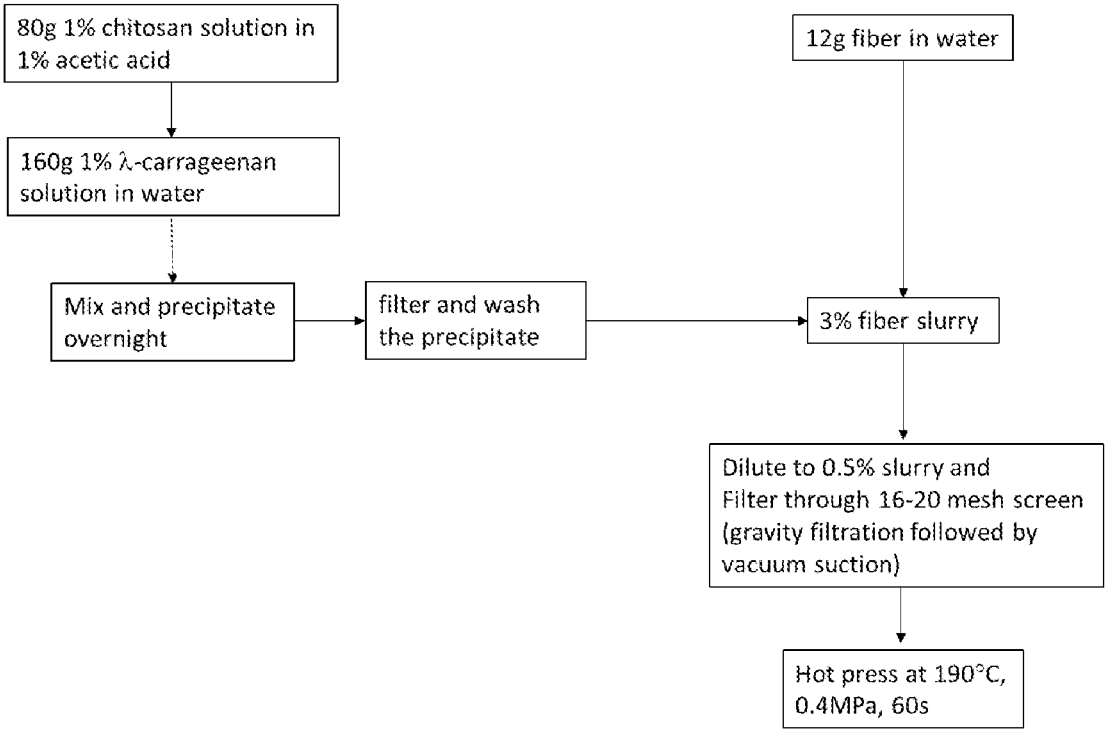
FIG. 5 shows the steps for preparing an exemplary oil and water-resistant composite material with an acid-soluble polysaccharide and a water-soluble polysaccharide.
Figure 6:
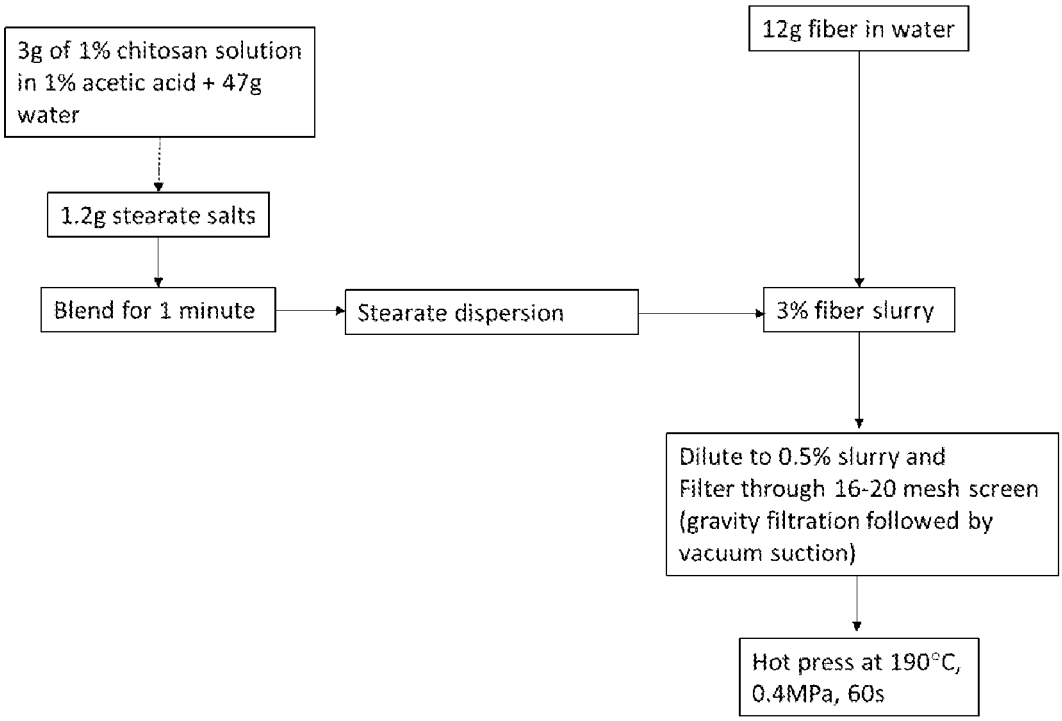
FIG. 6 shows the steps for preparing an exemplary oil and water-resistant composite material with a salt of fatty acid and a polysaccharide.

A number of embodiments of the disclosure have been described. Nevertheless, it will be understood that various modifications may be made without departing from the spirit and scope of the invention. Accordingly, other embodiments are within the scope of the following claims.

Definitions

To facilitate understanding of the disclosure set forth herein, a number of terms are defined below. Unless defined otherwise, all technical and scientific terms used herein generally have the same meaning as commonly understood by one of ordinary skill in the art to which this disclosure belongs. Publications cited herein and the materials for which they are cited are specifically incorporated by reference.

General Definitions

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof. Other than where noted, all numbers expressing quantities of ingredients, reaction conditions, geometries, dimensions, and so forth used in the specification and claims are to be understood at the very least, and not as an attempt to limit the application of the doctrine of equivalents to the scope of the claims, to be construed in light of the number of significant digits and ordinary rounding approaches.

Accordingly, these terms are intended to not only cover the recited element(s) or step(s), but may also include other elements or steps not expressly recited. Furthermore, as used herein, the use of the terms "a", "an", and "the" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

Ranges can be expressed herein as from "about" one particular value, and/or to "about" another particular value. By "about" is meant within 5% of the value, e.g., within 4, 3, 2, or 1% of the value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. A range may be construed to include the start and the end of the range. For example, a range of 10% to 20% (i.e., range of 10%-20%) can includes 10% and also includes 20%, and includes percentages in between 10% and 20%, unless explicitly stated otherwise herein.

As used herein, the terms "may," "optionally," and "may optionally" are used interchangeably and are meant to include cases in which the condition occurs as well as cases in which the condition does not occur. Thus, for example, the statement that a formulation "may include an excipient" is meant to include cases in which the formulation includes an excipient as well as cases in which the formulation does not include an excipient.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein.

Compositions

Provided herein is a fiber matrix including a pulped fiber, a polysaccharide, and a fatty acid or salt, ester, amide, derivative thereof, or any combination thereof, an acid, or any combination thereof distributed within the fiber matrix. In some embodiments, the fiber matrix can include a pulped fiber, a polysaccharide, a fatty acid or salt, ester, amide, derivative thereof, or any combination thereof, and an acid distributed within the fiber matrix. In some embodiments, the fiber matrix can include a pulped fiber, a polysaccharide, and a fatty acid or salt, ester, amide, derivative thereof, or any combination thereof distributed within the fiber matrix. In some embodiments, the fiber matrix can include a pulped fiber, a polysaccharide, and an acid distributed within the fiber matrix.

In some embodiments, the polysaccharide can include a non-ionizable polysaccharide, cationic polysaccharide, anionic polysaccharide, or any combination thereof. In some embodiments, the polysaccharide can include a non-ionizable polysaccharide. In some embodiments, the polysaccharide can include cationic polysaccharide. In some embodiments, the polysaccharide can include anionic polysaccharide. In some embodiments, the polysaccharide can include a non-ionizable polysaccharide, a cationic polysaccharide, and an anionic polysaccharide. In some embodiments, the polysaccharide can include a non-ionizable polysaccharide, and a cationic polysaccharide. In some embodiments, the polysaccharide can include a non-ionizable polysaccharide, and an anionic polysaccharide. In some embodiments, the polysaccharide can include a cationic polysaccharide, and an anionic polysaccharide.

In some embodiments, the fiber matrix including a pulped fiber, a cationic polysaccharide, an anionic polysaccharide, non-ionizable polysaccharide, or any combination thereof and a fatty acid or salt, ester, amide, derivative thereof, or any combination thereof, an acid, or any combination thereof distributed within the fiber matrix. In some embodiments, the fiber matrix can include a pulped fiber, a cationic polysaccharide, an anionic polysaccharide, non-ionizable polysaccharide, or any combination thereof, a fatty acid or salt, ester, amide, derivative thereof, or any combination thereof, and an acid distributed within the fiber matrix. In some embodiments, the fiber matrix can include a pulped fiber, a cationic polysaccharide, an anionic polysaccharide, non-ionizable polysaccharide, or any combination thereof, and a fatty acid or salt, ester, amide, derivative thereof, or any combination thereof distributed within the fiber matrix. In some embodiments, the fiber matrix can include a pulped fiber, a cationic polysaccharide, an anionic polysaccharide, non-ionizable polysaccharide, or any combination thereof, an acid distributed within the fiber matrix.

In some embodiments, the fiber matrix including a pulped fiber, a cationic polysaccharide, and a fatty acid or salt, ester, amide, derivative thereof, or any combination thereof, an acid, or any combination thereof distributed within the fiber matrix. In some embodiments, the fiber matrix can include a pulped fiber, a cationic polysaccharide, a fatty acid or salt, ester, amide, derivative thereof, or any combination thereof, and an acid distributed within the fiber matrix. In some embodiments, the fiber matrix can include a pulped fiber, a cationic polysaccharide, and a fatty acid or salt, ester, amide, derivative thereof, or any combination thereof distributed within the fiber matrix. In some embodiments, the fiber matrix can include a pulped fiber, a cationic polysaccharide, and an acid distributed within the fiber matrix.

In some embodiments, the fiber matrix including a pulped fiber, a non-ionizable polysaccharide, and a fatty acid or salt, ester, amide, derivative thereof, or any combination thereof, an acid, or any combination thereof distributed within the fiber matrix. In some embodiments, the fiber matrix can include a pulped fiber, a non-ionizable polysaccharide, a fatty acid or salt, ester, amide, derivative thereof, or any combination thereof, and an acid distributed within the fiber matrix. In some embodiments, the fiber matrix can include a pulped fiber, a non-ionizable polysaccharide, and a fatty acid or salt, ester, amide, derivative thereof, or any combination thereof distributed within the fiber matrix. In some embodiments, the fiber matrix can include a pulped fiber, a non-ionizable polysaccharide, and an acid distributed within the fiber matrix.

In some embodiments, the fiber matrix including a pulped fiber, an anionic polysaccharide, and a fatty acid or salt, ester, amide, derivative thereof, or any combination thereof, an acid, or any combination thereof distributed within the fiber matrix. In some embodiments, the fiber matrix can include a pulped fiber, an anionic polysaccharide, a fatty acid or salt, ester, amide, derivative thereof, or any combination thereof, and an acid distributed within the fiber matrix. In some embodiments, the fiber matrix can include a pulped fiber, an anionic polysaccharide, and a fatty acid or salt, ester, amide, derivative thereof, or any combination thereof distributed within the fiber matrix. In some embodiments, the fiber matrix can include a pulped fiber, an anionic polysaccharide, and an acid distributed within the fiber matrix.

In some embodiments, when the fiber matrix includes a pulped fiber, a polysaccharide, and a fatty acid or salt, ester, amide, derivative thereof, or any combination thereof, an acid, or any combination thereof, then the fiber matrix can further include an internal sizing agent, a filler, or any combination thereof.

In some embodiments, when the fiber matrix includes a pulped fiber, a polysaccharide, and a fatty acid or salt, ester, amide, derivative thereof, or any combination thereof, an acid, or any combination thereof, then the fiber matrix can further include an internal sizing agent. In some embodiments, a polysaccharide, and a fatty acid or salt, ester, amide, derivative thereof, or any combination thereof, an acid, or any combination thereof, then the fiber matrix can further include a filler. In some embodiments, when the fiber matrix includes a pulped fiber, a polysaccharide, and a fatty acid or salt, ester, amide, derivative thereof, or any combination thereof, an acid, or any combination thereof, then the fiber matrix can further include an internal sizing agent, and a filler.

In some embodiments, when the fiber matrix includes a pulped fiber, a non-ionizable polysaccharide, cationic polysaccharide, anionic polysaccharide, or any combination thereof, and a fatty acid or salt, ester, amide, derivative thereof, or any combination thereof, an acid, or any combination thereof, then the fiber matrix can further include an internal sizing agent. In some embodiments, a non-ionizable polysaccharide, cationic polysaccharide, anionic polysaccharide, or any combination thereof, and a fatty acid or salt, ester, amide, derivative thereof, or any combination thereof, an acid, or any combination thereof, then the fiber matrix can further include a filler. In some embodiments, when the fiber matrix includes a pulped fiber, a non-ionizable polysaccharide, cationic polysaccharide, anionic polysaccharide, or any combination thereof, and a fatty acid or salt, ester, amide, derivative thereof, or any combination thereof, an acid, or any combination thereof, then the fiber matrix can further include an internal sizing agent, and a filler.

In some embodiments, the sum of the weight percent concentration of all polysaccharides and all fatty acid or salt, ester, amide, derivative thereof, or any combination thereof present in the fiber matrix can be at least greater than 5%, (e.g., at least 10%, at least 20%, at least 30%, at least 40%, or at least 50%). In some embodiments, the sum of the weight percent concentration of all polysaccharides and all fatty acid or salt, ester, amide, derivative thereof, or any combination thereof present in the fiber matrix can be 55% or less, (e.g., 50% or less, 40% or less, 30% or less, 20% or less, or 10% or less).

The sum of the weight percent concentration of all polysaccharides and all fatty acid or salt, ester, amide, derivative thereof, or any combination thereof present in the fiber matrix can range from any of the minimum values described above to any of the maximum values described above. For example, in some embodiments, the sum of the weight percent concentration of all polysaccharides and all fatty acid or salt, ester, amide, derivative thereof, or any combination thereof present in the fiber matrix can be from greater than 5% to 55%, (e.g., from greater than 5% to 50%, from greater than 5% to 45%, from greater than 5% to 40%, from greater than 5% to 35%, from greater than 5% to 30%, from greater than 5% to 25%, from greater than 5% to 20%, from greater than 5% to 15%, from greater than 5% to 10%, from 10% to 50%, from 10% to 55%, from 10% to 50%, from 10% to 45%, from 10% to 40%, from 10% to 35%, from 10% to 30%, from 10% to 25%, from 10% to 20%, from 20% to 55%, from 20% to 50%, from 20% to 45%, from 20% to 40%, from 20% to 35%, from 20% to 30%, from 20% to 25%, from 30% to 55%, from 30% to 50%, from 30% to 45%, from 30% to 40%, from 30% to 35%, from 40% to 55%, from 40% to 50%, from 40% to 45%, or from 50% to 55%).

For example, in some embodiments, when the fiber matrix includes a pulped fiber, an acid, and a cationic polysaccharide, then the fiber matrix can further include a fatty acid or salt, ester, amide, derivative thereof, or any combination thereof, an internal sizing agent, a filler, an anionic polysaccharide, or any combination thereof.

Provided herein is also a fiber matrix including a pulped fiber and a fatty acid or salt, ester, amide, derivative thereof, or any combination thereof distributed within the fiber matrix.

In some embodiments, when the fiber matrix includes a pulped fiber, and a fatty acid or salt, ester, amide, derivative thereof, or any combination thereof, then the fiber matrix can further include an internal sizing agent, a filler, a polysaccharide, an acid, a surfactant, or any combination thereof. In some embodiments, the polysaccharide can be a non-ionizable polysaccharide, a cationic polysaccharide, an anionic polysaccharide, or any combination thereof. In some embodiments, when the fiber matrix includes a pulped fiber, and a fatty acid or salt, ester, amide, derivative thereof, or any combination thereof, then the fiber matrix can further include an internal sizing agent. In some embodiments, when the fiber matrix includes a pulped fiber, and a fatty acid or salt, ester, amide, derivative thereof, or any combination thereof, then the fiber matrix can further include a filler. In some embodiments, when the fiber matrix includes a pulped fiber, and a fatty acid or salt, ester, amide, derivative thereof, or any combination thereof, then the fiber matrix can further include a surfactant. In some embodiments, when the fiber matrix includes a pulped fiber, and a fatty acid or salt, ester, amide, derivative thereof, or any combination thereof, then the fiber matrix can further include an acid. In some embodiments, when the fiber matrix includes a pulped fiber, and a fatty acid or salt, ester, amide, derivative thereof, or any combination thereof, then the fiber matrix can further include an internal sizing agent, a filler, a polysaccharide, and a surfactant. In some embodiments, when the fiber matrix includes a pulped fiber, and a fatty acid or salt, ester, amide, derivative thereof, or any combination thereof, then the fiber matrix can further include an internal sizing agent, a filler, and a surfactant. In some embodiments, when the fiber matrix includes a pulped fiber, and a fatty acid or salt, ester, amide, derivative thereof, or any combination thereof, then the fiber matrix can further include an internal sizing agent and a surfactant. In some embodiments, when the fiber matrix includes a pulped fiber, and a fatty acid or salt, ester, amide, derivative thereof, or any combination thereof, then the fiber matrix can further include a filler and a surfactant. In some embodiments, when the fiber matrix includes a pulped fiber, and a fatty acid or salt, ester, amide, derivative thereof, or any combination thereof, then the fiber matrix can further include an internal sizing agent and a filler. In some embodiments, when the fiber matrix includes a pulped fiber, and a fatty acid or salt, ester, amide, derivative thereof, or any combination thereof, then the fiber matrix can further include an acid, internal sizing agent, a filler, a polysaccharide, and a surfactant. In some embodiments, when the fiber matrix includes a pulped fiber, and a fatty acid or salt, ester, amide, derivative thereof, or any combination thereof, then the fiber matrix can further include an acid, an internal sizing agent, a filler, and a surfactant. In some embodiments, when the fiber matrix includes a pulped fiber, and a fatty acid or salt, ester, amide, derivative thereof, or any combination thereof, then the fiber matrix can further include an acid, an internal sizing agent and a surfactant. In some embodiments, when the fiber matrix includes a pulped fiber, and a fatty acid or salt, ester, amide, derivative thereof, or any combination thereof, then the fiber matrix can further include an acid, a filler, and a surfactant. In some embodiments, when the fiber matrix includes a pulped fiber, and a fatty acid or salt, ester, amide, derivative thereof, or any combination thereof, then the fiber matrix can further include an acid, an internal sizing agent and a filler. In some embodiments, when the fiber matrix includes a pulped fiber, and a fatty acid or salt, ester, amide, derivative thereof, or any combination thereof, then the fiber matrix can further include an acid and an internal sizing agent. In some embodiments, when the fiber matrix includes a pulped fiber, and a fatty acid or salt, ester, amide, derivative thereof, or any combination thereof, then the fiber matrix can further include an acid and a filler. In some embodiments, when the fiber matrix includes a pulped fiber, and a fatty acid or salt, ester, amide, derivative thereof, or any combination thereof, then the fiber matrix can further include an acid and a surfactant. In some embodiments, when the fiber matrix includes a pulped fiber, and a fatty acid or salt, ester, amide, derivative thereof, or any combination thereof, then the fiber matrix can further include an acid and a polysaccharide.

In some embodiments, when the fiber matrix includes a pulped fiber, and a fatty acid or salt, ester, amide, derivative thereof, or any combination thereof, then the fiber matrix can further include an acid, internal sizing agent, a filler, a cationic polysaccharide, and a surfactant. In some embodiments, when the fiber matrix includes a pulped fiber, and a fatty acid or salt, ester, amide, derivative thereof, or any combination thereof, then the fiber matrix can further include an acid, an internal sizing agent, a cationic polysaccharide, and a surfactant. In some embodiments, when the fiber matrix includes a pulped fiber, and a fatty acid or salt, ester, amide, derivative thereof, or any combination thereof, then the fiber matrix can further include an acid, a filler, cationic polysaccharide, and a surfactant.

In some embodiments, the fiber matrix does not include a fluorocarbon or a non-compostable synthetic polymer; or adding an oil and grease resistant coating.

Acids

Suitable acid can include, but are not limited to, hydrochloric acid, phosphoric acid, sulfuric acid, nitric acid, lactic acid, acetic acid, formic acid, malic acid, propionic acid, adipic acid, glycolic acid, citric acid, oxalic acid, uric acid, tartaric acid, or any combination thereof.

In some embodiments, the acid can be present in the fiber matrix in a concentration of at least 0.1% (e.g., at least 1%, at least 5%, at least 10%, at least 20%, at least 30%, at least 50%, at least 60%, at least 70%, at least 80%, or at least 90%) by weight of the polysaccharide. In some embodiments, the acid can be present the fiber matrix in a concentration of 100% or less, (e.g., 90% or less, 80% or less, 70% or less, 60% or less, 50% or less, 40% or less, 30% or less, 20% or less, 10% or less, 5% or less, 1% or less, or 0.5% or less) by weight of the polysaccharide.

The acid can be present in a concentration ranging from any of the minimum values described above to any of the maximum values described above. For example, in some embodiments, the acid can be present in the fiber matrix a concentration of from 0.1% to 100% (e.g., from 0.1% to 90%, from 0.1% to 80%, from 0.1% to 70%, from 0.1% to 60%, from 0.1% to 50%, from 0.1% to 40%, from 0.1% to 30%, from 0.1% to 20%, from 0.1% to 10%, from 0.1% to 5%, from 0.1% to 1%, from 1% to 100%, from 1% to 90%, from 1% to 80%, from 1% to 70%, from 1% to 60%, from 1% to 50%, from 1% to 40%, from 1% to 30%, from 1% to 20%, from 1% to 10%, from 1% to 5%, from 10% to 100%, from 10% to 90%, from 10% to 80%, from 10% to 70%, from 10% to 60%, from 10% to 50%, from 10% to 40%, from 10% to 30%, from 10% to 20%, from 20% to 100%, from 20% to 90%, from 20% to 80%, from 20% to 70%, from 20% to 60%, from 20% to 50%, from 20% to 40%, from 20% to 30%, from 30% to 100%, from 30% to 90%, from 30% to 80%, from 30% to 70%, from 30% to 60%, from 30% to 50%, from 30% to 40%, from 40% to 100%, from 40% to 90%, from 40% to 80%, from 40% to 70%, from 40% to 60%, from 40% to 50%, from 50% to 100%, from 50% to 90%, from 50% to 80%, from 50% to 70%, from 50% to 60%, from 70% to 100%, from 70% to 90%, from 70% to 80%, from 60% to 100%, from 60% to 90%, from 60% to 80%, from 60% to 70%, from 80% to 100%, from 80% to 90%, or from 90% to 100%) by weight of the polysaccharide.

Polysaccharides

Suitable polysaccharides can include, but are not limited to, non-ionizable polysaccharides, cationic polysaccharides, anionic polysaccharides, modified polysaccharides, or any combination thereof. Modified polysaccharides can be prepared by physically, enzymatically, or chemically altering the inherent properties of the polysaccharides.

Examples of starches are corn starch, potato starch, wheat starch, rice starch, tapioca starch, arrowroot starch, sorghum starch, sago starch, pea starch, banana starch, chayotexle starch, coconut starch, chemically modified starches, partially gelatinized starches, pre-gelatinized high amylose starches, nanoparticulate starches, or dried starch polyelectrolyte complexes, among others.

In some embodiments, the polysaccharide can be present in a concentration of at least 1% by weight of the fiber matrix (e.g., at least 5%, at least 10% or at least 15%). In some embodiments, when the fiber matrix includes a pulped fiber a polysaccharide, and a fatty acid or salt, ester, amide, derivative thereof, or any combination thereof, an acid, or any combination thereof, then the polysaccharide can be present in a concentration of 20% or less by weight of the fiber matrix (e.g., 15% or less, 10% or less, 5% or less).

The polysaccharide can be present in a concentration ranging from any of the minimum values described above to any of the maximum values described above. For example, in some embodiments, the polysaccharide can be present in a concentration of from 1% to 20% by weight of the fiber matrix (e.g., from 1% to 5%, from 1% to 10%, from 1% to 15%, from 5% to 20%, from 5% to 15%, from 5% to 10%, from 10% to 20%, from 10% to 15%, or from 15% to 20%).

Cationic Polysaccharide

Suitable cationic polysaccharide can include, but are not limited to, chitin, chitosan, partially deacetylated chitin, cationic starch, cationic cellulose, cationic dextran, cationic guar gum, or any combination thereof. The modification of starch and other polysaccharides by chemical derivatization to produce various cationic polysaccharides is well known. Cationic polysaccharides, i.e., polysaccharides which have been modified so that they have a positive electrostatic charge. As used herein, the term "cationic polysaccharides" refers to a modified polysaccharides containing one or more cationic groups, cationizable groups, or mixtures thereof. The one or more cationic groups can include quaternary, tertiary, secondary amines, other nitrogen-containing, positive electrostatically charged groups, sulfonium and phosphonium groups and any other cationic group which can be substituted onto starch without causing starch degradation. It is well known that the cationicity of primary, secondary and tertiary amines is dependent upon the pH of the system. At low PH levels, these amines tend to be strongly cationic. At high pH levels these amines do not ionize. Quaternary amines, on the other hand, are cationic under all pH conditions. By "cationic polysaccharide" is meant a polysaccharide carrying a positive charge which causes attraction or migration to the cathode. By the term "cationic polysaccharides as used in the specification and claims herein, we mean polysaccharide products which contain any of the cationic groups listed herein and mixtures thereof. Such polysaccharides are characterized by higher cationicity than the base from which the derivative was prepared. The presence of other modifying groups, such as anionic groups, on the polysaccharide would tend to change the degree of cationicity of the product, depending on the pH level of the system. Examples of cationic polysaccharides are described in U.S. Pat. No. 6,193,843, which is hereby incorporated by reference in its entirety. In some embodiments, the cationic polysaccharide can include chitosan. In some embodiments, the cationic polysaccharide can include chitin. In some embodiments, the cationic polysaccharide can include cationic starch.

The term "cationic starch" can also include a modified starch containing one or more cationic groups, or mixtures thereof. Modified starches can be prepared by physically, enzymatically, or chemically altering the inherent properties of the starches to have a cationic charge. Examples of cationic starches are described in U.S. Pat. Nos. 6,193,843, 3,354,034, 3,666,751, 4,060,683, 2,989,520, and 3,077,469, which are hereby incorporated by reference in its entirety. In some embodiments, the cationic starch can be defined by:

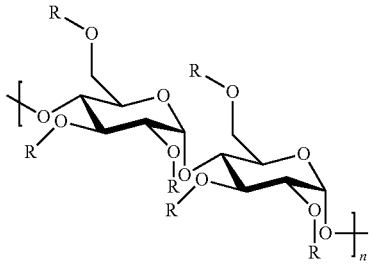

wherein

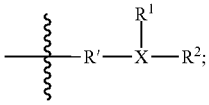

R are independently selected from H or

X is N, S, or P;

R' is selected from substituted or unsubstituted alkyl, alkylene, hydroxyalkyl, or hydroxyalkylene;

$R^1$ and $R^2$ are independently selected from substituted or unsubstituted hydrogen, alkyl, alkylene, hydroxyalkyl, hydroxyalkylene, —R'—Y,

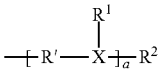

aryl, or arylalkyl;

n is an integer from 10 and 1000;

a is an integer from 0 to 3; and

Y is selected from —OH, —$NH_2$, —NHR', —NR'R', or —NR'R'R', wherein at least one R is

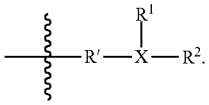

In some embodiments, the cationic starch can be defined by:

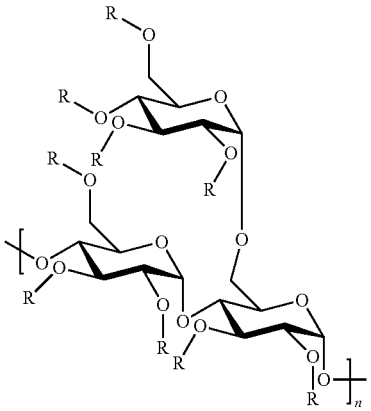

wherein

R are independently selected from H or

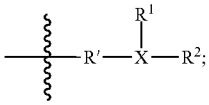

X is N, S, or P;

R' is selected from substituted or unsubstituted alkyl, alkylene, hydroxyalkyl, or hydroxyalkylene;

$R^1$ and $R^2$ are independently selected from substituted or unsubstituted hydrogen, alkyl, alkylene, hydroxyalkyl, hydroxyalkylene, —R'—Y,

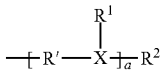

aryl, or arylalkyl;

n is an integer from 10 and 1000;

a is an integer from 0 to 3; and

Y is selected from —OH, —$NH_2$, —NHR', —NR'R', or —NR'R'R', wherein at least one R is

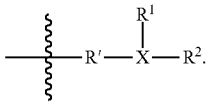

In some embodiments, the cationic starch can be

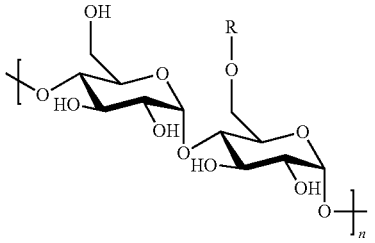

wherein

R is

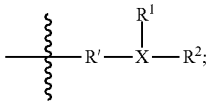

X is N;

R' is selected from substituted or unsubstituted alkyl, alkylene, hydroxyalkyl, or hydroxyalkylene;

$R^1$ and $R^2$ are independently selected from substituted or unsubstituted hydrogen, alkyl, alkylene, hydroxyalkyl, hydroxyalkylene, —R'—Y,

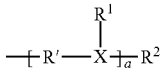

aryl, or arylalkyl;

n is an integer from 10 and 1000;

a is an integer from 0 to 3; and

Y is selected from —OH, —$NH_2$, —NHR', —NR'R', or —NR'R'R'.

In some embodiments, the cationic starch can be

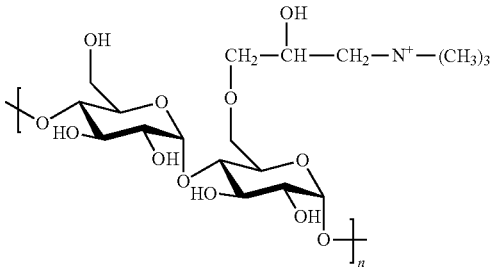

wherein

R is

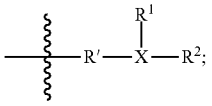

X is N;

R' is selected from substituted or unsubstituted alkyl, alkylene, hydroxyalkyl, or hydroxyalkylene;

$R^1$ and $R^2$ are independently selected from substituted or unsubstituted hydrogen, alkyl, alkylene, hydroxyalkyl, hydroxyalkylene, —R'—Y,

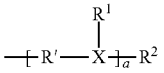

aryl, or arylalkyl;

n is an integer from 10 and 1000;

a is an integer from 0 to 3; and

Y is selected from —OH, —$NH_2$, —NHR', —NR'R', or —NR'R'R'.

In some embodiments, the cationic polysaccharide can include chitosan. In some embodiments, the cationic polysaccharide can include chitin. In some embodiments, the cationic polysaccharide can include partially deacetylated chitin. In some embodiments, the cationic polysaccharide can include cationic starch.

In some embodiments, the cationic polysaccharide can be present in a concentration of at least 1% by weight of the fiber matrix (e.g., at least 5%, at least 10% or at least 15%). In some embodiments, the cationic polysaccharide can be present in a concentration of 20% or less by weight of the fiber matrix (e.g., 15% or less, 10% or less, 5% or less).

The cationic polysaccharide can be present in a concentration ranging from any of the minimum values described above to any of the maximum values described above. For example, in some embodiments, the cationic polysaccharide can be present in a concentration of from 1% to 20% by weight of the fiber matrix (e.g., from 1% to 5%, from 1% to 10%, from 1% to 15%, from 5% to 20%, from 5% to 15%, from 5% to 10%, from 10% to 20%, from 10% to 15%, or from 15% to 20%).

In some embodiments, the cationic starch can be present in a concentration of at least 1% by weight of the fiber matrix (e.g., at least 5%, at least 10%, or at least 15%). In some embodiments, the cationic starch can be present in a concentration of 20% or less by weight of the fiber matrix (e.g, 15% or less, 10% or less, or 5% or less).

The cationic starch can be present in a concentration ranging from any of the minimum values described above to any of the maximum values described above. For example, in some embodiments, the cationic polysaccharide can be present in a concentration of from 1% to 20% by weight of the fiber matrix (e.g., from 1% to 5%, from 1% to 10%, from 1% to 15%, from 5% to 20%, from 5% to 15%, from 5% to 10%, from 10% to 20%, from 10% to 15%, or from 15% to 20%).

In some embodiments, the chitosan can be present in a concentration of at least 1% by weight of the fiber matrix (e.g., at least 5%, at least 10%, or at least 15%). In some embodiments, the chitosan can be present in a concentration of 20% or less by weight of the fiber matrix (e.g, 15% or less, 10% or less, or 5% or less).

The chitosan can be present in a concentration ranging from any of the minimum values described above to any of the maximum values described above. For example, in some embodiments, the chitosan can be present in a concentration of from 1% to 20% by weight of the fiber matrix (e.g., from 1% to 5%, from 1% to 10%, from 1% to 15%, from 5% to 20%, from 5% to 15%, from 5% to 10%, from 10% to 20%, from 10% to 15%, or from 15% to 20%).

Anionic Polysaccharide

In some embodiments, the fiber matrix can further include an anionic polysaccharide. Suitable anionic polysaccharide can include, but are not limited to, heparin, hyaluronic acid, carrageenan, alginic acid, alginate, chondroitin sulfate, or any combination thereof.

In some embodiments, the anionic polysaccharide can be present in a concentration of at least 1% by weight of the fiber matrix (e.g., at least 5%, at least 10% or at least 15%). In some embodiments, the anionic polysaccharide can be present in a concentration of 20% or less by weight of the fiber matrix (e.g., 15% or less, 10% or less, 5% or less).

The anionic polysaccharide can be present in a concentration ranging from any of the minimum values described above to any of the maximum values described above. For example, in some embodiments, the anionic polysaccharide can be present in a concentration of from 1% to 20% by weight of the fiber matrix (e.g., from 1% to 5%, from 1% to 10%, from 1% to 15%, from 5% to 20%, from 5% to 15%, from 5% to 10%, from 10% to 20%, from 10% to 15%, or from 15% to 20%).

Non-Ionizable Polysaccharide

Suitable non-ionizable polysaccharides can include, but are not limited to, starch, cellulose, hemicellulose, dextran, guar gum, tera gum, glucomannan, curdlan, or any combination thereof.

In some embodiments, the non-ionizable polysaccharide can be present in a concentration of at least 1% by weight of the fiber matrix (e.g., at least 5%, at least 10% or at least 15%). In some embodiments, the non-ionizable polysaccharide can be present in a concentration of 20% or less by weight of the fiber matrix (e.g., 15% or less, 10% or less, 5% or less).

The non-ionizable polysaccharide can be present in a concentration ranging from any of the minimum values described above to any of the maximum values described above. For example, in some embodiments, the non-ionizable polysaccharide can be present in a concentration of from 1% to 20% by weight of the fiber matrix (e.g., from 1% to 5%, from 1% to 10%, from 1% to 15%, from 5% to 20%, from 5% to 15%, from 5% to 10%, from 10% to 20%, from 10% to 15%, or from 15% to 20%).

Fatty Acid or Salt, Ester, Amide, Derivative Thereof, or any Combination Thereof As used herein, the term "fatty acid" is intended to represent a carboxylic acid with at least 8 carbon atoms. In one example, the fatty acid or salt or ester thereof can comprise at least 9, at least 10, at least 12, at least 14, at least 16, at least 18, or at least 20 carbon atoms. In some specific examples, the fatty acid or the ester thereof can contain 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, or 45 carbon atoms. In other examples, the fatty acid or the salt or ester thereof can comprise a mixture of fatty acids or the esters thereof having a range of carbon atoms. For example, the fatty acid or the ester thereof can comprise from 8 to 40, from 10 to 40, from 12 to 38, from 14 to 36, from 16 to 34, from 18 to 32, or from 20 to 30 carbon atoms.

It is also understood that by the term "fatty acid," that the carboxyl group could be in either protonated or deprotonated form (i.e., meaning $RCO_2$— as well as $RCO_2H$, where R is the hydrocarbyl chain). Thus, phrases like glyceride with a saturated fatty acid are understood to mean molecules where the carboxyl portion of the saturated fatty acid is bonded to the glycerol molecule via an ester bond. This convention and nomenclature is typically used by those in the field.

The fatty acids or salts or esters thereof can be saturated, unsaturated, or a mixture of saturated and unsaturated fatty acids. As used herein, the term "saturated" is intended to mean that the molecule or residue contains no carbon-carbon double or triple bounds. As used herein, the term "unsaturated" is intended to mean that the molecule or residue contains at least one carbon-carbon double or triple bond.

Examples of specific saturated fatty acids include, but are not limited to, capric acid (C10), lauric acid (C12), myristic acid (C14), palmitic acid (C16), margaric acid (C17), stearic acid (C18), arachidic acid (C20), behenic acid (C22), lignoceric acid (C24), cerotic acid (C26), montanic acid (C28), and melissic acid (C30), including branched and substituted derivatives thereof.

Examples of unsaturated fatty acids can comprise one carbon-carbon double bond. Examples of such monounsaturated fatty acids include but are not limited to oleic, palmitoleic, myristoleic, petroselinic, linoleic, linolenic, vaccenic, gadolenic, cetoleic, erucic, selacholeic, ximenic, and lumequic acids. Unsaturated fatty acids can comprise at least two unsaturated bonds. In some examples, the unsaturated fatty acids can comprise at least one pair of methylene interrupted unsaturated bonds. By "methylene interrupted unsaturated bond" is meant that one carbon-carbon double or triple bond is separated from another carbon-carbon double or triple bond by at least one methylene group (i.e., $CH_2$). Specific examples of unsaturated fatty acids that contain at least one pair of methylene interrupted unsaturated bonds include, but are not limited to, the n-1 family derived from 9, 12, 15-16:3; n-2 family derived from 9, 12, 15-17:3, 15:3, 17:3, 17:4, 20:4; n-3 family derived from 9, 12, 15-18:3, 15:2, 15:3, 15:4, 16:3, 16:4, 18:3 (linolenic), 18:4, 18:5, 20:2, 20:3, 20:4; 20:5 (EPA), 21:5, 22:3, 22:5 (DPA), 22:6 (DHA), 24:3, 24:4, 24:5, 24:6, 26:5, 26:6, 28:7, 30:5; n-4 family derived from 9, 12-16:2, 16:2, 16:3, 18:2, 18:3; n-5 family derived from 9, 12-17:2, 15:2, 17:2, 17:3, 19:2, 19:4, 20:3, 20:4 21:4, 21:5; n-6 family derived from 9, 12-18:2, 15:2, 16:2, 18:2 (linoleic acid), 18:3 (linolenic acid); 20:2, 20:3, 20:4 (arachidonic acid), 22:2, 22:3, 22:4 (adrenic acid), 22:5, 24:2, 24:4, 25:2, 26:2, 30:4; n-7 family derived from 9-16:1, 15:2, 16:2, 17:2, 18:2, 19:2; n-8 family derived from 9-17:1, 15:2, 16:2, 17:2, 18:2, 19:2; n-9 family derived from 9-18:1, 17:2, 18:2, 20:2, 20:3, 22:3, 22:4; n-11 family 19:2, and the n-12 family 20:2. (The compounds are identified by referring first to the "n-x family," where x is the position in the fatty acid where the first double bond begins. The numbering scheme begins at the terminal end of the fatty acid, where, for example, the terminal $CH_3$ group is designated position 1. The next number identifies the total number of carbon atoms in the fatty acid. The third number, which is after the colon, designates the total number of double bonds in the fatty acid. So, for example, in the n-1 family, 16:3, refers to a 16 carbon long fatty acid with 3 double bonds, each separated by a methylene, wherein the first double bond begins at position 1, i.e., the terminal end of the fatty acid).

In some embodiments, fatty acids can include, but are not limited to, oleic acid, caprylic acid, pelargonic acid, capric acid, lauric acid, myristic acid, palmitic acid, margaric acid, stearic acid, arachidic acid, behenic acid, lignoceric acid, cerotic acid, montanic acid, melissic acid, oleic acid, palmitoleic acid, myristoleic acid, linoleic acid, linolenic acid, petroselinic acid, vaccenic acid, gadolenic acid, cetoleic acid, crucic acid, selacholeic acid, ximenic acid, lumequic acid, or any combination thereof.

In some embodiments, fatty acid salts can include, but are not limited to, ammonium salts of the fatty acid, sodium salts of the fatty acid, potassium salts of the fatty acid, calcium salts of the fatty acid, zinc salts of the fatty acid, magnesium salts of the fatty acid, iron salts of the fatty acid, manganese salts of the fatty acid, aluminum salts of the fatty acid, or any combination thereof.

In some embodiments, fatty acid esters can include, but are not limited to, esters of oleate, esters of caprylate, esters of pelargonate, esters of caprate, esters of laurate, esters of myristate, esters of palmitate, esters of stearate, esters of lignocerate, esters of behenate, esters of montanate, esters of melissate, esters of palmitoleate, esters of myristoleate, esters of linoleate, esters of linolenate, esters of petroselinate, esters of vaccenate, esters of gadolenate, esters of cetoleate, esters of erucate, esters of selacholeate, esters of ximenate, esters of lumequate or any combination thereof. For example, oleyl oleate, oleyl, laurate, oleyl capylate, oleyl palmitate, oleyl citrate, oleyl behenate, oleyl stearate, lauryl sterate, lauryl oleate, lauryl laurate, lauryl capylate, lauryl palmitate, lauryl citrate, lauryl behenate, palmityl oleate, palmityl laurate, palmityl stearate, palmityl capylate, palmityl palmitate, palmityl citrate, palmityl behenate, behenyl stearate, behenyl oleate, behenyl laurate, behenyl capylate, behenyl palmiate, behenyl citrate, behenyl behenate, myristyl stearate, myristyl oleate, myristyl laurate, myristyl capylate, myristyl palmitate, myristyl citrate, myristyl behenate, stearyl oleate, stearyl caprylate, stearyl pelargonate, stearyl caprate, stearyl laurate, stearyl myristate, stearyl lignocerate, stearyl acetate, stearyl citrate, stearyl palmitate, stearyl stearate, stearyl behenate, arachidyl linoleate, arachidyl linolenate, arachidyl myristoleate, arachidyl oleate, arachidyl palmitate, behenyl linoleate, behenyl linolenate, behenyl myristoleate, claidyl palmitate, gondoyl linoleate, gondoyl linolenate, lauryl linoleate, lauryl linolenate lauryl myristoleate, lauryl palmitoleate, linolenyl arachidate, linolenyl behenate, linolenyl laurate, linolenyl linoleate, linolenyl linolenate, linolenyl myristate, linolenyl oleate, linolenyl palmitate, linolenyl palmitatoleate, linolenyl stearate, linoleyl arachidate, linoleyl arachidonate, linoleyl behenate, linoleyl laurate, linoleyl linoleate, linoleyl linolenate, linoleyl myristate, linoleyl myristoleate, linoleyl oleate, linoleyl palmitate, linoleyl palmitatoleate, linoleyl stearate, myristoleyl arachidate, myristoleyl arachidonate, myristoleyl behenate, myristoleyl laurate, myristoleyl linoleate, myristoleyl linolenate, myristoleyl myristate, myristoleyl myristoleate, myristoleyl oleate, myristoleyl palmitate, myristoleyl palmitoleate, myristoleyl stearate, myristyl linoleate, myristyl linolenate, oleyl arachidate, oleyl arachidonate, oleyl linoleate, oleyl linolenate, oleyl myristoleate, olcyl palmitoleate, palmitoleyl arachidate, palmitoleyl arachidonate, palmitoleyl behenate, palmitolcyl laurate, palmitoleyl linoleate, palmitoleyl linolenate, palmitoleyl myristate, palmitoleyl myristoleate, palmitoleyl oleate, palmitoleyl palmitate, palmitoleyl palmitoleate, palmitoleyl stearate, palmityl linoleate, palmityl linolenate, palmityl myristoleate, palmityl palmitoleate, palmityl stearate, stearyl linoleate, stearyl linolenate, stearyl myristoleate, or any combination thereof.

In some embodiments, fatty acid amides can include, but are not limited to, amides of oleate, amides of caprylate, amides of pelargonate, amides of caprate, amides of laurate, amides of myristate, amides of palmitate, amides of stearate, amides of lignocerate, amides of behenate, amides of montanate, amides of melissate, amides of palmitoleate, amides of myristoleate, amides of linoleate, amides of linolenate, amides of petroselinate, amides of vaccenate, amides of gadolenate, amides of cetoleate, amides of erucate, amides of selacholeate, amides of ximenate, amides of lumequate or any combination thereof. For example, stearamide, ethylene bis-stearamide, oleamide, ethylene bis-Oleamide, or any combination thereof.

In some embodiments, the fatty acid or salt, ester, amide, derivative thereof, or any combination thereof can include a zinc stearate, magnesium stearate, stearic acid, aluminum stearate, or any combination thereof. In some embodiments, the fatty acid, or salt, ester, amide, or derivative can include zinc stearate. In some embodiments, the fatty acid, or salt, ester, amide, or derivative can include stearic acid.

In some embodiments, when present the fatty acid or salt, ester, amide, derivative thereof, or any combination thereof can be present in a concentration of at least 0.1% by weight of the fiber matrix (e.g., at least 0.5%, at least 1%, at least 5%, at least 10%, at least 15%, at least 20%, at least 25%, at least 30%, at least 35%, at least 40%, or at least 45%). In some embodiments, when the fiber matrix includes a pulped fiber, an acid, and a cationic polysaccharide, then the fatty acid or salt, ester, amide, derivative thereof, or any combination thereof can be present in a concentration of 50% or less (e.g., 45% or less, 40% or less, 35% or less, 30% or less, 25% or less, 20% or less, 15% or less, 10% or less, 5% or less, 1% or less, or 0.5% or less) by weight of the fiber matrix.

When present the fatty acid or salt, ester, amide, derivative thereof, or any combination thereof can be present in a concentration ranging from any of the minimum values described above to any of the maximum values described above. For example, in some embodiments, the fatty acid or salt, ester, amide, derivative thereof, or any combination thereof can be present in a concentration of from 0.1% to 50% by weight of the fiber matrix (e.g. from 0.1% to 1%, from 0.1% to 5%, from 0.1% to 10%, from 0.1% to 15%, from 0.1% to 20%, from 0.1% to 25%, from 0.1% to 30%, from 0.1% to 35%, from 0.1% to 40%, from 0.1% to 45%, from 0.5% to 1%, from 0.5% to 5%, from 0.5% to 10%, from 0.5% to 15%, from 0.5% to 20%, from 0.5% to 25%, from 0.5% to 30%, from 0.5% to 35%, from 0.5% to 40%, from 0.5% to 45%, from 0.5% to 50%, from 1% to 5%, from 1% to 10%, from 1% to 15%, from 1% to 20%, from 1% to 25%, from 1% to 30%, from 1% to 35%, from 1% to 40%, from 1% to 45%, from 1% to 50%, from 5% to 10%, from 5% to 15%, from 5% to 20%, from 5% to 25%, from 5% to 30%, from 5% to 35%, from 5% to 40%, from 5% to 45%, from 5% to 50%, from 10% to 15%, from 10% to 20%, from 10% to 30%, from 10% to 40%, from 10% to 50%, from 20% to 30%, from 20% to 40%, from 20% to 50%, from 30% to 40%, from 30% to 40%, from 30% to 50%, or from 40% to 50%).

For example, in some embodiments, when present the fatty acid or salt, ester, amide, derivative thereof, or any combination thereof can be present in a concentration of at least 0.1% by weight of the fiber matrix (e.g., at least 0.5%, at least 1%, at least 2%, at least 3%, at least 4%, at least 5%, at least 6%, at least 7%, at least 8%, or at least 9%). In some embodiments, when the fiber matrix includes a pulped fiber, an acid, and a cationic polysaccharide, then the fatty acid or salt, ester, amide, derivative thereof, or any combination thereof can be present in a concentration of 10% or less by weight of the fiber matrix (e.g., 9% or less, 8% or less, 7% or less, 6% or less, 5% or less, 4% or less, 3% or less, 2% or less, 1% or less, or 0.5% or less).

When present the fatty acid or salt, ester, amide, derivative thereof, or any combination thereof can be present in a concentration ranging from any of the minimum values described above to any of the maximum values described above. For example, in some embodiments, the fatty acid or salt, ester, amide, derivative thereof, or any combination thereof can be present in a concentration of from 0.1% to 10% by weight of the fiber matrix (e.g. from 0.1% to 1%, from 0.1% to 2%, from 0.1% to 3%, from 0.1% to 4%, from 0.1% to 5%, from 0.1% to 6%, from 0.1% to 7%, from 0.1% to 8%, from 0.1% to 9%, from 0.5% to 1%, from 0.5% to 2%, from 0.5% to 3%, from 0.5% to 4%, from 0.5% to 5%, from 0.5% to 6%, from 0.5% to 7%, from 0.5% to 8%, from 0.5% to 9%, from 0.5% to 10%, from 1% to 2%, from 1% to 3%, from 1% to 4%, from 1% to 5%, from 1% to 6%, from 1% to 7%, from 1% to 8%, from 1% to 9%, from 1% to 10%, from 2% to 3%, from 2% to 4%, from 2% to 5%, from 2% to 6%, from 2% to 7%, from 2% to 8%, from 2% to 9%, from 2% to 10%, from 3% to 4%, from 3% to 5%, from 3% to 6%, from 3% to 7%, from 3% to 8%, from 3% to 9%, from 3% to 10%, from 4% to 5%, from 4% to 6%, from 4% to 7%, from 4% to 8%, from 4% to 9%, from 4% to 10%, from 5% to 6%, from 5% to 7%, from 5% to 8%, from 5% to 9%, from 5% to 10%, from 6% to 7%, from 6% to 8%, from 6% to 9%, from 6% to 10%, from 7% to 8%, from 7% to 9%, from 7% to 10%, from 7% to 8%, from 7% to 9%, from 7% to 10%, from 8% to 9%, from 8% to 10%, or from 9% to 10%).

In some other embodiments, for example, when the fiber matrix includes a pulped fiber, and a fatty acid or salt, ester, amide, derivative thereof, or any combination thereof and optionally an internal sizing agent, a filler, a surfactant, or any combination thereof, then the fatty acid or salt, ester, amide, derivative thereof, or any combination thereof can be present in a concentration of at least 15% by weight of the fiber matrix (e.g., at least 20%, at least 25%, at least 30%, at least 35%, at least 40%, or at least 45%). In some embodiments, when the fiber matrix includes a pulped fiber, and a fatty acid or salt, ester, amide, derivative thereof, or any combination thereof, then the fatty acid or salt, ester, amide, derivative thereof, or any combination thereof can be present in a concentration of 50% or less by weight of the fiber matrix (e.g., 45% or less, 40% or less, 35% or less, 30% or less, 25% or less, 20% or less, 15% or less, 10% or less, or 5% or less).

When the fiber matrix includes a pulped fiber, and a fatty acid or salt, ester, amide, derivative thereof, or any combination thereof, then the fatty acid or salt, ester, amide, derivative thereof, or any combination thereof can be present in a concentration ranging from any of the minimum values described above to any of the maximum values described above. For example, in some embodiments, the fatty acid or salt, ester, amide, derivative thereof, or any combination thereof can be present in a concentration of from 15% to 50% by weight of the fiber matrix (e.g., from 15% to 20%, from 15% to 25%, from 15% to 30%, from 15% to 35%, from 15% to 40%, from 15% to 45%, from 20% to 50%, from 20% to 45%, from 20% to 40%, from 20% to 35%, from 20% to 30%, from 20% to 25%, from 30% to 40%, from 30% to 50%, or from 40% to 50%).

Internal Sizing Agent

Suitable internal sizing agent described herein can include, but are not limited to, an alkyl, alkenyl, aryl, alkaryl ketene dimer, alkenyl succinic anhydride, rosin, wax, stearic anhydride, or other fatty acid anhydride. In some embodiments, the internal sizing agent can include an alkyl ketene dimer.

In some embodiments, the internal sizing agent can be present in a concentration of at least 0.03% by weight of the fiber matrix (e.g., at least 0.1%, at least 0.5%, at least 1%, at least 5%, at least 10%, at least 20%, at least 30%, at least 40%, at least 50%, at least 60%, at least 70%, or at least 80%). In some embodiments, the internal sizing agent can be present in a concentration of 90% or less by weight of the fiber matrix (e.g., 80% or less, 70% or less, 60% or less, 50% or less, 40% or less, 30% or less, 20% or less, 10% or less, 5% or less, 1% or less, 0.5% or less, or 0.1% or less).

The internal sizing agent can be present in a concentration ranging from any of the minimum values described above to any of the maximum values described above. For example, in some embodiments, the internal sizing agent can be present in a concentration of from 0.03% to 90% by weight of the fiber matrix (e.g., from 0.03% to 90%, from 0.03% to 80%, from 0.03% to 70%, from 0.03% to 60%, from 0.03% to 50%, from 0.03% to 40%, from 0.03% to 30%, from 0.03% to 20%, from 0.03% to 10%, from 0.03% to 5%, from 0.03% to 1%, from 1% to 90%, from 1% to 80%, from 1% to 70%, from 1% to 60%, from 1% to 50%, from 1% to 40%, from 1% to 30%, from 1% to 20%, from 1% to 10%, from 1% to 5%, from 5% to 90%, from 5% to 80%, from 5% to 70%, from 5% to 60%, from 5% to 50%, from 5% to 40%, from 5% to 30%, from 5% to 20%, from 5% to 10%, from 10% to 90%, from 10% to 80%, from 10% to 70%, from 10% to 60%, from 10% to 50%, from 10% to 40%, from 10% to 30%, from 10% to 20%, from 20% to 90%, from 20% to 80%, from 20% to 70%, from 20% to 60%, from 20% to 50%, from 20% to 40%, from 20% to 30%, from 30% to 90%, from 30% to 80%, from 30% to 70%, from 30% to 60%, from 30% to 50%, from 30% to 40%, from 40% to 90%, from 40% to 80%, from 40% to 70%, from 40% to 60%, from 40% to 50%, from 50% to 90%, from 50% to 80%, from 50% to 70%, from 50% to 60%, from 60% to 90%, from 60% to 80%, from 60% to 70%, from 70% to 90%, from 70% to 80%, or from 80% to 90%).

Filler

Suitable filler materials described herein can include, but are not limited to a mineral (e.g., calcium carbonate, titanium dioxide, talc, or clay), a lignocellulose particle, or any compostable material useful as a filler, either biodegradable or inorganic, or any combination thereof.

Surfactants

The term "surfactant" refers to a compound that when added to a composition, reduces its surface tension, thereby increasing its spreading and wetting properties. Surfactants can be anionic surfactants, cationic surfactants, zwitterionic surfactants, amphoteric surfactants, non-ionic surfactants.

Exemplary surfactants can include polymeric surfactants of lignin, starch and cellulose such as lignosulfonates, lignocarboxylates, lignoglyoxalates, amphoteric starches, starch octenylsuccinates, carboxymethyl starch, hydroxyethyl starch, carboxymethyl cellulose, hydroxypropylmethyl cellulose, polyoxyethylene derivatives of fatty acids, partial esters of sorbitol anhydrides, Tween (e.g., Tween 20, Tween 40, Tween 60, Tween 80 and the like), Span (e.g., Span 20, Span 40, Span 80 and the like), polyoxyl 40 stearate, polyoxy ethylene 50 stearate, edetate disodium, glycerol monooleate, fusieates, bile salts, octoxynol, ammonium stearate, sodium stearate, potassium stearate, sodium dodecyl sulfate (SDS), cetyl trimethyl ammonium bromide (CTAB), 4-(5-dodecyl)benzenesulfonate, docusate (dioctyl sodium sulfosuccinate), alkyl ether phosphates or benzalkaonium chloride (BAC), or any combination thereof.

Fiber

The fiber described herein can include a cellulosic fiber. As used herein, the term "cellulosic fiber" is meant to include any fiber incorporating cellulose as a major constituent. Cellulosic fibers can include, but is not limited to, virgin pulps, recycled (secondary) cellulosic fibers, or fiber mixtures comprising reconstituted cellulosic fibers. Cellulosic fibers suitable for making the fibrous sheet of this invention include non-wood fibers, and wood fibers. Non-wood fibers may be cotton fibers or cotton derivatives, abaca, kenaf, sabai grass, flax, esparto grass, straw, jute, hemp, bagasse, milkweed floss fibers, and pineapple leaf fibers. Wood fibers may be those obtained from deciduous and coniferous trees, and may be softwood fibers or hardwood fibers. Softwood fibers include Northern and Southern softwood Kraft fibers; and hardwood fibers include Eucalyptus, maple, birch, aspen, or the like. Papermaking fibers can include naturally occurring pulp-derived fibers as well as reconstituted cellulosic fibers such as lyocell or rayon. Pulp-derived fibers are liberated from their source material by any one of a number of pulping processes familiar to one experienced in the art. The pulping process may include sulfate, sulfite, polysulfide, soda pulping, etc. If desired, the pulp can be bleached by chemical means including the use of chlorine, chlorine dioxide, oxygen, alkaline peroxide, and so forth. Naturally occurring pulp-derived fibers are referred to herein simply as "pulp-derived" papermaking fibers. The products of the present invention may comprise a blend of conventional fibers (whether derived from virgin pulp or recycle sources) and high coarseness lignin-rich tubular fibers, such as bleached chemical thermomechanical pulp (BCTMP). Pulp-derived fibers may also include high yield fibers such as BCTMP as well as thermomechanical pulp (TMP), chemi-thermomechanical pulp (CTMP) and alkaline peroxide mechanical pulp (APMP).

The fiber matrix can be water and oil resistant when compressed and heated. In some embodiments, the fiber matrix can be hot water resistant, cold water resistant, hot oil resistant, cold oil resistant, or any combination thereof. Oil resistance can be measured by applying 90° C. oil to the fiber matrix and assessing oil absorption and/or leakage after 2 hours. Water resistance can be measured by applying boiling water to the fiber matrix and assessing water absorption and/or leakage after 1 hour.

Methods

Described herein are methods for preparing a fiber matrix, the method including blending pulped fiber, a polysaccharide, and a fatty acid or salt, ester, amide, derivative thereof, or any combination thereof, acid, or any combination thereof and water to create a slurry; casting the slurry to a wet mat of product shape; and compressing and heating the wet mat to remove water to form the fiber matrix.

In some embodiments, the methods for preparing a fiber matrix can include blending pulped fiber, polysaccharide, and a fatty acid or salt, ester, amide, derivative thereof, or any combination thereof and water to create a slurry; casting the slurry to a wet mat of product shape; and compressing and heating the wet mat to remove water to form the fiber matrix.

In some embodiments, the methods for preparing a fiber matrix can include blending pulped fiber, polysaccharide, and an acid and water to create a slurry; casting the slurry to a wet mat of product shape; and compressing and heating the wet mat to remove water to form the fiber matrix.

In some embodiments, the methods for preparing a fiber matrix can include blending pulped fiber, polysaccharide, a fatty acid or salt, ester, amide, derivative thereof, or any combination thereof, an acid and water to create a slurry; casting the slurry to a wet mat of product shape; and compressing and heating the wet mat to remove water to form the fiber matrix.

In some embodiments, the methods can further include blending an internal sizing agent, a filler, or any combination thereof with the pulped fiber, polysaccharide, fatty acid or salt, ester, amide, derivative thereof, or any combination thereof, an acid, or any combination thereof, and water to create the slurry.

In some embodiments, the method can further include blending a filler material with the pulped fiber, polysaccharide, fatty acid or salt, ester, amide, derivative thereof, or any combination thereof, an acid, or any combination thereof, and water to create the slurry. In some embodiments, the methods can further include blending an internal sizing agent thereof with the pulped fiber, polysaccharide, fatty acid or salt, ester, amide, derivative thereof, or any combination thereof, an acid, or any combination thereof, and water to create the slurry. In some embodiments, the methods can further include blending an internal sizing agent, and a filler thereof with the pulped fiber, polysaccharide, fatty acid or salt, ester, amide, derivative thereof, or any combination thereof, an acid, or any combination thereof, and water to create the slurry.

In some embodiments, the polysaccharide can include a non-ionizable polysaccharide, cationic polysaccharide, anionic polysaccharide, or any combination thereof. In some embodiments, the polysaccharide can include a non-ionizable polysaccharide. In some embodiments, the polysaccharide can include cationic polysaccharide. In some embodiments, the polysaccharide can include anionic polysaccharide. In some embodiments, the polysaccharide can include a non-ionizable polysaccharide, a cationic polysaccharide, and an anionic polysaccharide. In some embodiments, the polysaccharide can include a non-ionizable polysaccharide, and a cationic polysaccharide. In some embodiments, the polysaccharide can include a non-ionizable polysaccharide, and an anionic polysaccharide. In some embodiments, the polysaccharide can include a cationic polysaccharide, and an anionic polysaccharide.

In some embodiments, the methods for preparing a fiber matrix can include blending pulped fiber, non-ionizable polysaccharide, cationic polysaccharide, anionic polysaccharide, or any combination thereof, and a fatty acid or salt, ester, amide, derivative thereof, or any combination thereof, an acid, or any combination thereof and water to create a slurry; casting the slurry to a wet mat of product shape; and compressing and heating the wet mat to remove water to form the fiber matrix.

In some embodiments, the methods for preparing a fiber matrix can include blending pulped fiber, cationic polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the fiber matrix.

In some embodiments, the methods for preparing a fiber matrix can include blending pulped fiber, anionic polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the fiber matrix.

In some embodiments, the methods for preparing a fiber matrix can include blending pulped fiber, non-ionizable polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the fiber matrix.

Described herein are also methods for preparing a fiber matrix, the method comprising blending pulped fiber, a fatty acid or salt, ester, amide, derivative thereof, or any combination thereof, and water, to create a slurry distributed within the slurry; casting the slurry to a wet mat of product shape; and compressing and heating the wet mat to remove water to form the fiber matrix. In some embodiments, the fiber matrix can be oil and water resistant.

In some embodiments, the methods can further include blending an internal sizing agent, a filler, a polysaccharide, a surfactant, an acid, or any combination thereof with the pulped fiber, water, and fatty acid or salt, ester, amide, derivative thereof, or any combination thereof to create the slurry. In some embodiments, the method can further include blending a filler with the pulped fiber, water, and fatty acid or salt, ester, amide, derivative thereof, or any combination thereof to create the slurry. In some embodiments, the methods can further include blending an internal sizing agent, a filler, a polysaccharide, and surfactant with the pulped fiber, water, and fatty acid or salt, ester, amide, derivative thereof, or any combination thereof to create the slurry. In some embodiments, the methods can further include blending an internal sizing agent, and a filler with the pulped fiber, water, and fatty acid or salt, ester, amide, derivative thereof, or any combination thereof to create the slurry. In some embodiments, the methods can further include blending a polysaccharide and a surfactant with the pulped fiber, water, and fatty acid or salt, ester, amide, derivative thereof, or any combination thereof to create the slurry. In some embodiments, the methods can further include blending a filler, a polysaccharide, and a surfactant with the pulped fiber, water, and fatty acid or salt, ester, amide, derivative thereof, or any combination thereof to create the slurry.

In some embodiments, the method can further include blending an acid, and a filler with the fiber, water, and fatty acid or salt, ester, amide, derivative thereof, or any combination thereof to create the slurry. In some embodiments, the methods can further include blending and acid, an internal sizing agent, a filler, a polysaccharide, and surfactant with the pulped fiber, water, and fatty acid or salt, ester, amide, derivative thereof, or any combination thereof to create the slurry. In some embodiments, the methods can further include blending an acid, an internal sizing agent, and a filler with the pulped fiber, water, and fatty acid or salt, ester, amide, derivative thereof, or any combination thereof to create the slurry. In some embodiments, the methods can further include blending an acid, a polysaccharide and a surfactant with the pulped fiber, water, and fatty acid or salt, ester, amide, derivative thereof, or any combination thereof to create the slurry. In some embodiments, the methods can further include blending an acid, a filler, a polysaccharide, and a surfactant with the pulped fiber, water, and fatty acid or salt, ester, amide, derivative thereof, or any combination thereof to create the slurry.

In some embodiments, the polysaccharide can include a non-ionizable polysaccharide, cationic polysaccharide, anionic polysaccharide, or any combination thereof. In some embodiments, the polysaccharide can include a non-ionizable polysaccharide. In some embodiments, the polysaccharide can include cationic polysaccharide. In some embodiments, the polysaccharide can include anionic polysaccharide. In some embodiments, the polysaccharide can include a non-ionizable polysaccharide, a cationic polysaccharide, and an anionic polysaccharide. In some embodiments, the polysaccharide can include a non-ionizable polysaccharide, and a cationic polysaccharide. In some embodiments, the polysaccharide can include a non-ionizable polysaccharide, and an anionic polysaccharide. In some embodiments, the polysaccharide can include a cationic polysaccharide, and an anionic polysaccharide.

In some embodiments, the methods can further include blending an acid, an internal sizing agent, a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry. In some embodiments, the methods can further include blending an acid, a non-ionizable polysaccharide, cationic polysaccharide, anionic polysaccharide, or any combination thereof and a surfactant with the pulped fiber, water, and fatty acid or salt, ester, amide, derivative thereof, or any combination thereof to create the slurry. In some embodiments, the methods can further include blending an acid, a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry.

In some embodiments, the methods can further include blending an internal sizing agent, a filler, a non-ionizable polysaccharide, cationic polysaccharide, anionic polysaccharide, or any combination thereof, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry. In some embodiments, the methods can further include blending a non-ionizable polysaccharide, cationic polysaccharide, anionic polysaccharide, or any combination thereof and a surfactant with the pulped fiber, water, and fatty acid or salt, ester, amide, derivative thereof, or any combination thereof to create the slurry. In some embodiments, the methods can further include blending a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry.

In some embodiments, the methods can further include blending an acid, an internal sizing agent, a filler, a cationic polysaccharide, and a surfactant with the pulped fiber, water, and fatty acid or salt, ester, amide, derivative thereof, or any combination thereof to create the slurry. In some embodiments, the methods can further include blending an acid, a cationic polysaccharide and a surfactant with the pulped fiber, water, and fatty acid or salt, ester, amide, derivative thereof, or any combination thereof to create the slurry. In some embodiments, the methods can further include blending an acid, a filler, a cationic polysaccharide, and a surfactant with the pulped fiber, water, and fatty acid or salt, ester, amide, derivative thereof, or any combination thereof to create the slurry.

In some embodiments, the methods can further include blending an internal sizing agent, a filler, a cationic polysaccharide, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, a cationic polysaccharide, and a surfactant with the pulped fiber, water, and fatty acid or salt, ester, amide, derivative thereof, or any combination thereof to create the slurry. In some embodiments, the methods can further include blending a cationic polysaccharide and a surfactant with the pulped fiber, water, and fatty acid or salt, ester, amide, derivative thereof, or any combination thereof to create the slurry. In some embodiments, the methods can further include blending a filler, a cationic polysaccharide, and a surfactant with the pulped fiber, water, and fatty acid or salt, ester, amide, derivative thereof, or any combination thereof to create the slurry.

In some embodiments, the methods can further include blending an acid, an internal sizing agent, a filler, an anionic polysaccharide, and a surfactant with the pulped fiber, water, and fatty acid or salt, ester, amide, derivative thereof, or any combination thereof to create the slurry. In some embodiments, the methods can further include blending an acid, an anionic polysaccharide and a surfactant with the pulped fiber, water, and fatty acid or salt, ester, amide, derivative thereof, or any combination thereof to create the slurry. In some embodiments, the methods can further include blending an acid, a filler, an anionic polysaccharide, and a surfactant with the pulped fiber, water, and fatty acid or salt, ester, amide, derivative thereof, or any combination thereof to create the slurry.

In some embodiments, the methods can further include blending an internal sizing agent, a filler, an anionic polysaccharide, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, an anionic polysaccharide, and a surfactant with the pulped fiber, water, and fatty acid or salt, ester, amide, derivative thereof, or any combination thereof to create the slurry. In some embodiments, the methods can further include blending an anionic polysaccharide and a surfactant with the pulped fiber, water, and fatty acid or salt, ester, amide, derivative thereof, or any combination thereof to create the slurry. In some embodiments, the methods can further include blending a filler, an anionic polysaccharide, and a surfactant with the pulped fiber, water, and fatty acid or salt, ester, amide, derivative thereof, or any combination thereof to create the slurry.

In some embodiments, the methods can further include blending an acid, an internal sizing agent, a filler, a non-ionizable polysaccharide, and a surfactant with the pulped fiber, water, and fatty acid or salt, ester, amide, derivative thereof, or any combination thereof to create the slurry. In some embodiments, the methods can further include blending an acid, a non-ionizable polysaccharide and a surfactant with the pulped fiber, water, and fatty acid or salt, ester, amide, derivative thereof, or any combination thereof to create the slurry. In some embodiments, the methods can further include blending an acid, a filler, a non-ionizable polysaccharide, and a surfactant with the pulped fiber, water, and fatty acid or salt, ester, amide, derivative thereof, or any combination thereof to create the slurry.

In some embodiments, the methods can further include blending an internal sizing agent, a filler, a non-ionizable polysaccharide, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, a non-ionizable polysaccharide, and a surfactant with the pulped fiber, water, and fatty acid or salt, ester, amide, derivative thereof, or any combination thereof to create the slurry. In some embodiments, the methods can further include blending a non-ionizable polysaccharide and a surfactant with the pulped fiber, water, and fatty acid or salt, ester, amide, derivative thereof, or any combination thereof to create the slurry. In some embodiments, the methods can further include blending a filler, a non-ionizable polysaccharide, and a surfactant with the pulped fiber, water, and fatty acid or salt, ester, amide, derivative thereof, or any combination thereof to create the slurry.

In some embodiments, the acid can be present in the slurry in a concentration of least 0.1% (e.g., at least 1%, at least 5%, at least 10%, at least 20%, at least 30%, at least 50%, at least 60%, at least 70%, at least 80%, or at least 90%) by weight of the polysaccharide.

In some embodiments, the acid can be present in the slurry in a concentration of 100% or less, (e.g., 90% or less, 80% or less, 70% or less, 60% or less, 50% or less, 40% or less, 30% or less, 20% or less, 10% or less, 5% or less, 1% or less, or 0.5% or less) by weight of the polysaccharide.

The acid can be present in a concentration ranging from any of the minimum values described above to any of the maximum values described above. For example, in some embodiments, the acid can be present in the slurry in a concentration of from 0.1% to 100% (e.g., from 0.1% to 90%, from 0.1% to 80%, from 0.1% to 70%, from 0.1% to 60%, from 0.1% to 50%, from 0.1% to 40%, from 0.1% to 30%, from 0.1% to 20%, from 0.1% to 10%, from 0.1% to 5%, from 0.1% to 1%, from 1% to 100%, from 1% to 90%, from 1% to 80%, from 1% to 70%, from 1% to 60%, from 1% to 50%, from 1% to 40%, from 1% to 30%, from 1% to 20%, from 1% to 10%, from 1% to 5%, from 10% to 100%, from 10% to 90%, from 10% to 80%, from 10% to 70%, from 10% to 60%, from 10% to 50%, from 10% to 40%, from 10% to 30%, from 10% to 20%, from 20% to 100%, from 20% to 90%, from 20% to 80%, from 20% to 70%, from 20% to 60%, from 20% to 50%, from 20% to 40%, from 20% to 30%, from 30% to 100%, from 30% to 90%, from 30% to 80%, from 30% to 70%, from 30% to 60%, from 30% to 50%, from 30% to 40%, from 40% to 100%, from 40% to 90%, from 40% to 80%, from 40% to 70%, from 40% to 60%, from 40% to 50%, from 50% to 100%, from 50% to 90%, from 50% to 80%, from 50% to 70%, from 50% to 60%, from 70% to 100%, from 70% to 90%, from 70% to 80%, from 60% to 100%, from 60% to 90%, from 60% to 80%, from 60% to 70%, from 80% to 100%, from 80% to 90%, or from 90% to 100%) by weight of the polysaccharide.

In some embodiments, the polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the polysaccharide can be present in the slurry in a concentration of 40% or less by weight of the fiber matrix (e.g., 35% or less, 30% or less, 25% or less, 20% or less, 15% or less, 10% or less, or 5% or less).

The polysaccharide can be added to the slurry in a concentration ranging from any of the minimum values described above to any of the maximum values described above. For example, in some embodiments, the polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the non-ionizable polysaccharide, cationic polysaccharide, anionic polysaccharide, or any combination thereof can be present in the slurry in a concentration of at least 1% by weight of the fiber matrix (e.g., at least 5%, at least 10%, at least 15%, at least 20%, at least 25%, at least 30%, or at least 35%). In some embodiments, the non-ionizable polysaccharide, cationic polysaccharide, anionic polysaccharide, or any combination thereof can be present in the slurry in a concentration of 40% or less by weight of the fiber matrix (e.g., 35% or less, 30% or less, 25% or less, 20% or less, 15% or less, 10% or less, or 5% or less).

The non-ionizable polysaccharide, cationic polysaccharide, anionic polysaccharide, or any combination thereof can be added to the slurry in a concentration ranging from any of the minimum values described above to any of the maximum values described above. For example, in some embodiments, the polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the cationic polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the cationic polysaccharide can be present in the slurry in a concentration of 40% or less by weight of the fiber matrix (e.g., 35% or less, 30% or less, 25% or less, 20% or less, 15% or less, 10% or less, or 5% or less).

The cationic polysaccharide can be added to the slurry in a concentration ranging from any of the minimum values described above to any of the maximum values described above. For example, in some embodiments, the cationic polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the anionic polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the anionic polysaccharide can be present in the slurry in a concentration of 40% or less by weight of the fiber matrix (e.g., 35% or less, 30% or less, 25% or less, 20% or less, 15% or less, 10% or less, or 5% or less).

The anionic polysaccharide can be added to the slurry in a concentration ranging from any of the minimum values described above to any of the maximum values described above. For example, in some embodiments, the anionic polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the non-ionizable polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the non-ionizable polysaccharide can be present in the slurry in a concentration of 40% or less by weight of the fiber matrix (e.g., 35% or less, 30% or less, 25% or less, 20% or less, 15% or less, 10% or less, or 5% or less).

The non-ionizable polysaccharide can be added to the slurry in a concentration ranging from any of the minimum values described above to any of the maximum values described above. For example, in some embodiments, the non-ionizable polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, when present the fatty acid or salt, ester, amide, derivative thereof, or any combination thereof can be present in the slurry in a concentration of at least 0.1% by weight of the fiber matrix (e.g., at least 0.5%, at least 1%, at least 5%, at least 10%, at least 15%, at least 20%, at least 25%, at least 30%, at least 35%, at least 40%, at least 45%, at least 50%, at least 60%, or at least 70%). In some embodiments, when present the fatty acid or salt, ester, amide, derivative thereof, or any combination thereof can be present in the slurry in a concentration of 80% or less by weight of the fiber matrix (e.g., 70% or less, 60% or less, 50% or less, 45% or less, 40% or less, 35% or less, 30% or less, 25% or less, 20% or less, 15% or less, 10% or less, 5% or less, 1% or less, or 0.5% or less).

When present the fatty acid or salt, ester, amide, derivative thereof, or any combination thereof can be present in the slurry in a concentration ranging from any of the minimum values described above to any of the maximum values described above. For example, in some embodiments, the fatty acid or salt, ester, amide, derivative thereof, or any combination thereof can be present in the slurry in a concentration of from 0.1% to 80% by weight of the fiber matrix (e.g. from 0.1% to 1%, from 0.1% to 5%, from 0.1% to 10%, from 0.1% to 15%, from 0.1% to 20%, from 0.1% to 25%, from 0.1% to 30%, from 0.1% to 35%, from 0.1% to 40%, from 0.1% to 45%, from 0.1% to 50%, from 0.1% to 60%, from 0.1% to 70%, from 0.5% to 1%, from 0.5% to 5%, from 0.5% to 10%, from 0.5% to 15%, from 0.5% to 20%, from 0.5% to 25%, from 0.5% to 30%, from 0.5% to 35%, from 0.5% to 40%, from 0.5% to 45%, from 0.5% to 50%, from 0.5% to 60%, from 0.5% to 70%, from 0.5% to 80%, from 1% to 5%, from 1% to 10%, from 1% to 15%, from 1% to 20%, from 1% to 25%, from 1% to 30%, from 1% to 35%, from 1% to 40%, from 1% to 45%, from 1% to 50%, from 1% to 60%, from 1% to 70%, from 1% to 80%, from 5% to 10%, from 5% to 15%, from 5% to 20%, from 5% to 25%, from 5% to 30%, from 5% to 35%, from 5% to 40%, from 5% to 45%, from 5% to 50%, from 5% to 60%, from 5% to 70%, from 5% to 80%, from 10% to 15%, from 10% to 20%, from 10% to 30%, from 10% to 40%, from 10% to 50%, from 10% to 60%, from 10% to 70%, from 10% to 80%, from 20% to 30%, from 20% to 40%, from 20% to 50%, from 20% to 60%, from 20% to 70%, from 20% to 80%, from 30% to 40%, from 30% to 50%, from 30% to 60%, from 30% to 70%, from 30% to 80%, from 40% to 50%, from 40% to 60%, from 40% to 70%, from 40% to 80%, from 50% to 60%, from 50% to 70%, from 50% to 80%, from 60% to 70%, from 60% to 80%, or from 70% to 80%).

In some embodiments, when present the internal sizing agent can be present in the slurry in a concentration of at least 0.03% by weight of the fiber matrix (e.g., at least 0.1%, at least 0.5%, at least 1%, at least 5%, at least 10%, at least 20%, at least 30%, at least 40%, at least 50%, at least 60%, at least 70%, or at least 80%). In some embodiments, the internal sizing agent can be present in the slurry in a concentration of 90% or less by weight of the fiber matrix (e.g., 80% or less, 70% or less, 60% or less, 50% or less, 40% or less, 30% or less, 20% or less, 10% or less, 5% or less, 1% or less, 0.5% or less, or 0.1% or less).

The internal sizing agent can be present in the slurry in a concentration ranging from any of the minimum values described above to any of the maximum values described above. For example, in some embodiments, the internal sizing agent can be present in the slurry in a concentration of from 0.03% to 90% by weight of the fiber matrix (e.g., from 0.03% to 90%, from 0.03% to 80%, from 0.03% to 70%, from 0.03% to 60%, from 0.03% to 50%, from 0.03% to 40%, from 0.03% to 30%, from 0.03% to 20%, from 0.03% to 10%, from 0.03% to 5%, from 0.03% to 1%, from 1% to 90%, from 1% to 80%, from 1% to 70%, from 1% to 60%, from 1% to 50%, from 1% to 40%, from 1% to 30%, from 1% to 20%, from 1% to 10%, from 1% to 5%, from 5% to 90%, from 5% to 80%, from 5% to 70%, from 5% to 60%, from 5% to 50%, from 5% to 40%, from 5% to 30%, from 5% to 20%, from 5% to 10%, from 10% to 90%, from 10% to 80%, from 10% to 70%, from 10% to 60%, from 10% to 50%, from 10% to 40%, from 10% to 30%, from 10% to 20%, from 20% to 90%, from 20% to 80%, from 20% to 70%, from 20% to 60%, from 20% to 50%, from 20% to 40%, from 20% to 30%, from 30% to 90%, from 30% to 80%, from 30% to 70%, from 30% to 60%, from 30% to 50%, from 30% to 40%, from 40% to 90%, from 40% to 80%, from 40% to 70%, from 40% to 60%, from 40% to 50%, from 50% to 90%, from 50% to 80%, from 50% to 70%, from 50% to 60%, from 60% to 90%, from 60% to 80%, from 60% to 70%, from 70% to 90%, from 70% to 80%, or from 80% to 90%).

In some embodiments, the methods do not include adding a fluorocarbon or a non-compostable synthetic polymer; or adding an oil and grease resistant coating.

In some embodiments, the fiber matrix prepared by the methods described herein is a fiber matrix described herein.

Article of Manufacturing

Described herein are articles of manufacture made using the fiber matrix described herein and methods described herein. Described herein are also articles of manufacture including a fiber matrix including a pulped fiber and a polysaccharide distributed within the fiber matrix.

The article of manufacture can include a food container such as a box, a cup, a clamshell, a plate, a bowl, a tray, a carton, an envelope, a sack, a bag, a baggie, a liner, a partition, a wrapper, a film, sheet, or a cushioning material.

Described herein are also methods of making articles of manufacture can include blending a pulped fiber, a polysaccharide, and optionally a fatty acid or salt, ester, amide, derivative thereof, or any combination thereof, an acid, or any combination thereof and water to create a slurry; casting the slurry to a wet mat of product shape; and compressing and heating the wet mat to remove water to form the article of manufacture.

In some embodiments, the methods of making articles of manufacture can include blending a pulped fiber, a polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the article of manufacture.

In some embodiments, the methods of making articles of manufacture can include blending pulped fiber, polysaccharide, and a fatty acid or salt, ester, amide, derivative thereof, or any combination thereof and water to create a slurry; casting the slurry to a wet mat of product shape; and compressing and heating the wet mat to remove water to form the article of manufacture.

In some embodiments, the methods of making articles of manufacture can include blending pulped fiber, polysaccharide, and an acid and water to create a slurry; casting the slurry to a wet mat of product shape; and compressing and heating the wet mat to remove water to form the article of manufacture.

In some embodiments, the methods of making articles of manufacture can include blending pulped fiber, polysaccharide, a fatty acid or salt, ester, amide, derivative thereof, or any combination thereof, an acid and water to create a slurry; casting the slurry to a wet mat of product shape; and compressing and heating the wet mat to remove water to form the article of manufacture.

In some embodiments, the polysaccharide can include a non-ionizable polysaccharide, cationic polysaccharide, anionic polysaccharide, or any combination thereof. In some embodiments, the polysaccharide can include a non-ionizable polysaccharide. In some embodiments, the polysaccharide can include cationic polysaccharide. In some embodiments, the polysaccharide can include anionic polysaccharide. In some embodiments, the polysaccharide can include a non-ionizable polysaccharide, a cationic polysaccharide, and an anionic polysaccharide. In some embodiments, the polysaccharide can include a non-ionizable polysaccharide, and a cationic polysaccharide. In some embodiments, the polysaccharide can include a non-ionizable polysaccharide, and an anionic polysaccharide. In some embodiments, the polysaccharide can include a cationic polysaccharide, and an anionic polysaccharide.

In some embodiments, blending can include adding a polysaccharide in the form of a granular or insoluble particulate.

In some embodiments, the methods of making articles of manufacture can include blending pulped fiber, non-ionizable polysaccharide, cationic polysaccharide, anionic polysaccharide, or any combination thereof, and a fatty acid or salt, ester, amide, derivative thereof, or any combination thereof, an acid, or any combination thereof and water to create a slurry; casting the slurry to a wet mat of product shape; and compressing and heating the wet mat to remove water to form the article of manufacture.

In some embodiments, the methods of making articles of manufacture can include blending pulped fiber, cationic polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the article of manufacture.

In some embodiments, the methods of making articles of manufacture can include blending pulped fiber, anionic polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the article of manufacture.

In some embodiments, the methods of making articles of manufacture can include blending pulped fiber, non-ionizable polysaccharide, and a fatty acid or salt, ester, amide, derivative thereof, or any combination thereof, an acid, or any combination thereof and water to create a slurry; casting the slurry to a wet mat of product shape; and compressing and heating the wet mat to remove water to form the article of manufacture.

In some embodiments, the methods can further include blending an internal sizing agent, a filler, or any combination thereof with the pulped fiber, polysaccharide, fatty acid or salt, ester, amide, derivative thereof, or any combination thereof, an acid, or any combination thereof, and water to create the slurry.

In some embodiments, the method can further include blending a filler material with the pulped fiber, polysaccharide, fatty acid or salt, ester, amide, derivative thereof, or any combination thereof, an acid, or any combination thereof, and water to create the slurry. In some embodiments, the methods can further include blending an internal sizing agent thereof with the pulped fiber, polysaccharide, fatty acid or salt, ester, amide, derivative thereof, or any combination thereof, an acid, or any combination thereof, and water to create the slurry. In some embodiments, the methods can further include blending an internal sizing agent, and a filler thereof with the pulped fiber, polysaccharide, fatty acid or salt, ester, amide, derivative thereof, or any combination thereof, an acid, or any combination thereof, and water to create the slurry.

In some embodiments, the methods of making articles of manufacture can include blending pulped fiber; a polysaccharide; and water to create a slurry; casting the slurry to a wet mat of product shape; and compressing and heating the wet mat to remove water to form the article of manufacture.

In some embodiments, the polysaccharide can include a non-ionizable polysaccharide, cationic polysaccharide, anionic polysaccharide, or any combination thereof. In some embodiments, the polysaccharide can include a non-ionizable polysaccharide. In some embodiments, the polysaccharide can include cationic polysaccharide. In some embodiments, the polysaccharide can include anionic polysaccharide. In some embodiments, the polysaccharide can include a non-ionizable polysaccharide, a cationic polysaccharide, and an anionic polysaccharide. In some embodiments, the polysaccharide can include a non-ionizable polysaccharide, and a cationic polysaccharide. In some embodiments, the polysaccharide can include a non-ionizable polysaccharide, and an anionic polysaccharide. In some embodiments, the polysaccharide can include a cationic polysaccharide, and an anionic polysaccharide.

In some embodiments, blending can include adding a polysaccharide in the form of a granular or insoluble particulate.

In some embodiments, the methods of making articles of manufacture can include blending pulped fiber, non-ionizable polysaccharide, cationic polysaccharide, anionic polysaccharide, or any combination thereof, and water to create a slurry; casting the slurry to a wet mat of product shape; and compressing and heating the wet mat to remove water to form the article of manufacture.

In some embodiments, the methods of making articles of manufacture can include blending pulped fiber, cationic polysaccharide, and water to create a slurry; casting the slurry to a wet mat of product shape; and compressing and heating the wet mat to remove water to form the article of manufacture.

In some embodiments, the methods of making articles of manufacture can include blending pulped fiber, anionic polysaccharide, and water to create a slurry; casting the slurry to a wet mat of product shape; and compressing and heating the wet mat to remove water to form the article of manufacture.

In some embodiments, the methods of making articles of manufacture can include blending pulped fiber, non-ionizable polysaccharide, and water to create a slurry; casting the slurry to a wet mat of product shape; and compressing and heating the wet mat to remove water to form the articles of manufacture.

In some embodiments, the methods can further include blending a fatty acid or salt, ester, amide, derivative thereof, or any combination thereof, an internal sizing agent, a filler, an acid, or any combination thereof with the pulped fiber, water, and polysaccharide, to create the slurry.

In some embodiments, the method can further include blending a filler with the pulped fiber, water, and polysaccharide to create the slurry. In some embodiments, the methods can further include blending a fatty acid or salt, ester, amide, derivative thereof, or any combination thereof, an internal sizing agent, and a filler thereof with the pulped fiber, polysaccharide, and water to create the slurry. In some embodiments, the methods can further include blending a fatty acid or salt, ester, amide, derivative thereof, or any combination thereof, and a filler with the pulped fiber, water, and polysaccharide to create the slurry. In some embodiments, the methods can further include blending a fatty acid or salt, ester, amide, derivative thereof, or any combination thereof and an internal sizing agent with the pulped fiber, water, and polysaccharide to create the slurry. In some embodiments, the methods can further include blending an internal sizing agent, and a filler with the pulped fiber, water, and polysaccharide to create the slurry.

Described herein are also methods of making articles of manufacture comprising blending pulped fiber, fatty acid or salt, ester, amide, derivative thereof, or any combination thereof, and water to create a slurry; casting the slurry to a wet mat of product shape; and compressing and heating the wet mat to remove water to form the article of manufacture.

In some embodiments, the methods can further include blending an internal sizing agent, a filler, a polysaccharide, a surfactant, an acid, or any combination thereof with the pulped fiber, water, and fatty acid or salt, ester, amide, derivative thereof, or any combination thereof to create the slurry. In some embodiments, the method can further include blending a filler with the pulped fiber, water, and fatty acid or salt, ester, amide, derivative thereof, or any combination thereof to create the slurry. In some embodiments, the methods can further include blending an internal sizing agent, a filler, a polysaccharide, and surfactant with the pulped fiber, water, and fatty acid or salt, ester, amide, derivative thereof, or any combination thereof to create the slurry. In some embodiments, the methods can further include blending an internal sizing agent, and a filler with the pulped fiber, water, and fatty acid or salt, ester, amide, derivative thereof, or any combination thereof to create the slurry. In some embodiments, the methods can further include blending a polysaccharide and a surfactant with the pulped fiber, water, and fatty acid or salt, ester, amide, derivative thereof, or any combination thereof to create the slurry. In some embodiments, the methods can further include blending a filler, a polysaccharide, and a surfactant with the pulped fiber, water, and fatty acid or salt, ester, amide, derivative thereof, or any combination thereof to create the slurry.

In some embodiments, the method can further include blending an acid, and a filler with the fiber, water, and fatty acid or salt, ester, amide, derivative thereof, or any combination thereof to create the slurry. In some embodiments, the methods can further include blending and acid, an internal sizing agent, a filler, a polysaccharide, and surfactant with the pulped fiber, water, and fatty acid or salt, ester, amide, derivative thereof, or any combination thereof to create the slurry. In some embodiments, the methods can further include blending an acid, an internal sizing agent, and a filler with the pulped fiber, water, and fatty acid, or salt, ester, or derivative thereof to create the slurry. In some embodiments, the methods can further include blending an acid, a polysaccharide and a surfactant with the pulped fiber, water, and fatty acid or salt, ester, amide, derivative thereof, or any combination thereof to create the slurry. In some embodiments, the methods can further include blending an acid, a filler, a polysaccharide, and a surfactant with the pulped fiber, water, and fatty acid or salt, ester, amide, derivative thereof, or any combination thereof to create the slurry.

In some embodiments, the polysaccharide can include a non-ionizable polysaccharide, cationic polysaccharide, anionic polysaccharide, or any combination thereof. In some embodiments, the polysaccharide can include a non-ionizable polysaccharide. In some embodiments, the polysaccharide can include cationic polysaccharide. In some embodiments, the polysaccharide can include anionic polysaccharide. In some embodiments, the polysaccharide can include a non-ionizable polysaccharide, a cationic polysaccharide, and an anionic polysaccharide. In some embodiments, the polysaccharide can include a non-ionizable polysaccharide, and a cationic polysaccharide. In some embodiments, the polysaccharide can include a non-ionizable polysaccharide, and an anionic polysaccharide. In some embodiments, the polysaccharide can include a cationic polysaccharide, and an anionic polysaccharide.

In some embodiments, blending can include adding a polysaccharide in the form of a granular or insoluble particulate.

In some embodiments, the methods can further include blending an acid, an internal sizing agent, a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry. In some embodiments, the methods can further include blending an acid, a non-ionizable polysaccharide, cationic polysaccharide, anionic polysaccharide, or any combination thereof and a surfactant with the pulped fiber, water, and fatty acid or salt, ester, amide, derivative thereof, or any combination thereof to create the slurry. In some embodiments, the methods can further include blending an acid, a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry.

In some embodiments, the methods can further include blending an internal sizing agent, a filler, a non-ionizable polysaccharide, cationic polysaccharide, anionic polysaccharide, or any combination thereof, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry. In some embodiments, the methods can further include blending a non-ionizable polysaccharide, cationic polysaccharide, anionic polysaccharide, or any combination thereof and a surfactant with the pulped fiber, water, and fatty acid or salt, ester, amide, derivative thereof, or any combination thereof to create the slurry. In some embodiments, the methods can further include blending a filler, a non-ionizable polysaccharide, cationic polysaccharide, anionic polysaccharide, or any combination thereof, and a surfactant with the pulped fiber, water, and fatty acid or salt, ester, amide, derivative thereof, or any combination thereof to create the slurry.

In some embodiments, the methods can further include blending an acid, an internal sizing agent, a filler, a cationic polysaccharide, and a surfactant with the pulped fiber, water, and fatty acid or salt, ester, amide, derivative thereof, or any combination thereof to create the slurry. In some embodiments, the methods can further include blending an acid, a cationic polysaccharide and a surfactant with the pulped fiber, water, and fatty acid or salt, ester, amide, derivative thereof, or any combination thereof to create the slurry. In some embodiments, the methods can further include blending an acid, a filler, a cationic polysaccharide, and a surfactant with the pulped fiber, water, and fatty acid or salt, ester, amide, derivative thereof, or any combination thereof to create the slurry.

In some embodiments, the methods can further include blending an internal sizing agent, a filler, a cationic polysaccharide, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, a cationic polysaccharide, and a surfactant with the pulped fiber, water, and fatty acid or salt, ester, amide, derivative thereof, or any combination thereof to create the slurry. In some embodiments, the methods can further include blending a cationic polysaccharide and a surfactant with the pulped fiber, water, and fatty acid or salt, ester, amide, derivative thereof, or any combination thereof to create the slurry. In some embodiments, the methods can further include blending a filler, a cationic polysaccharide, and a surfactant with the pulped fiber, water, and fatty acid or salt, ester, amide, derivative thereof, or any combination thereof to create the slurry.

In some embodiments, the methods can further include blending an acid, an internal sizing agent, a filler, an anionic polysaccharide, and a surfactant with the pulped fiber, water, and fatty acid or salt, ester, amide, derivative thereof, or any combination thereof to create the slurry. In some embodiments, the methods can further include blending an acid, an anionic polysaccharide and a surfactant with the pulped fiber, water, and fatty acid or salt, ester, amide, derivative thereof, or any combination thereof to create the slurry. In some embodiments, the methods can further include blending an acid, a filler, an anionic polysaccharide, and a surfactant with the pulped fiber, water, and fatty acid or salt, ester, amide, derivative thereof, or any combination thereof to create the slurry.

In some embodiments, the methods can further include blending an internal sizing agent, a filler, an anionic polysaccharide, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, an anionic polysaccharide, and a surfactant with the pulped fiber, water, and fatty acid or salt, ester, amide, derivative thereof, or any combination thereof to create the slurry. In some embodiments, the methods can further include blending an anionic polysaccharide and a surfactant with the pulped fiber, water, and fatty acid or salt, ester, amide, derivative thereof, or any combination thereof to create the slurry. In some embodiments, the methods can further include blending a filler, an anionic polysaccharide, and a surfactant with the pulped fiber, water, and fatty acid or salt, ester, amide, derivative thereof, or any combination thereof to create the slurry.

In some embodiments, the methods can further include blending an acid, an internal sizing agent, a filler, a non-ionizable polysaccharide, and a surfactant with the pulped fiber, water, and fatty acid or salt, ester, amide, derivative thereof, or any combination thereof to create the slurry. In some embodiments, the methods can further include blending an acid, a non-ionizable polysaccharide and a surfactant with the pulped fiber, water, and fatty acid or salt, ester, amide, derivative thereof, or any combination thereof to create the slurry. In some embodiments, the methods can further include blending an acid, a filler, a non-ionizable polysaccharide, and a surfactant with the pulped fiber, water, and fatty acid or salt, ester, amide, derivative thereof, or any combination thereof to create the slurry.

In some embodiments, the methods can further include blending an internal sizing agent, a filler, a non-ionizable polysaccharide, a surfactant, an acid, or any combination thereof with the pulped fiber, water, and fatty acid or salt, ester, amide, derivative thereof, or any combination thereof to create the slurry. In some embodiments, the methods can further include blending an internal sizing agent, a filler, a non-ionizable polysaccharide, and a surfactant with the pulped fiber, water, and fatty acid or salt, ester, amide, derivative thereof, or any combination thereof to create the slurry. In some embodiments, the methods can further include blending a non-ionizable polysaccharide and a surfactant with the pulped fiber, water, and fatty acid or salt, ester, amide, derivative thereof, or any combination thereof to create the slurry. In some embodiments, the methods can further include blending a filler, a non-ionizable polysaccharide, and a surfactant with the pulped fiber, water, and fatty acid or salt, ester, amide, derivative thereof, or any combination thereof to create the slurry.

In some embodiments, the acid can be present in the slurry in a concentration of least 0.1% (e.g., at least 1%, at least 5%, at least 10%, at least 20%, at least 30%, at least 50%, at least 60%, at least 70%, at least 80%, or at least 90%) by weight of the polysaccharide.

In some embodiments, the acid can be present in the slurry in a concentration of 100% or less, (e.g., 90% or less, 80% or less, 70% or less, 60% or less, 50% or less, 40% or less, 30% or less, 20% or less, 10% or less, 5% or less, 1% or less, or 0.5% or less) by weight of the polysaccharide.

The acid can be present in a concentration ranging from any of the minimum values described above to any of the maximum values described above. For example, in some embodiments, the acid can be present in the slurry in a concentration of from 0.1% to 100% (e.g., from 0.1% to 90%, from 0.1% to 80%, from 0.1% to 70%, from 0.1% to 60%, from 0.1% to 50%, from 0.1% to 40%, from 0.1% to 30%, from 0.1% to 20%, from 0.1% to 10%, from 0.1% to 5%, from 0.1% to 1%, from 1% to 100%, from 1% to 90%, from 1% to 80%, from 1% to 70%, from 1% to 60%, from 1% to 50%, from 1% to 40%, from 1% to 30%, from 1% to 20%, from 1% to 10%, from 1% to 5%, from 10% to 100%, from 10% to 90%, from 10% to 80%, from 10% to 70%, from 10% to 60%, from 10% to 50%, from 10% to 40%, from 10% to 30%, from 10% to 20%, from 20% to 100%, from 20% to 90%, from 20% to 80%, from 20% to 70%, from 20% to 60%, from 20% to 50%, from 20% to 40%, from 20% to 30%, from 30% to 100%, from 30% to 90%, from 30% to 80%, from 30% to 70%, from 30% to 60%, from 30% to 50%, from 30% to 40%, from 40% to 100%, from 40% to 90%, from 40% to 80%, from 40% to 70%, from 40% to 60%, from 40% to 50%, from 50% to 100%, from 50% to 90%, from 50% to 80%, from 50% to 70%, from 50% to 60%, from 70% to 100%, from 70% to 90%, from 70% to 80%, from 60% to 100%, from 60% to 90%, from 60% to 80%, from 60% to 70%, from 80% to 100%, from 80% to 90%, or from 90% to 100%) by weight of the polysaccharide.

In some embodiments, the polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the polysaccharide can be present in the slurry in a concentration of 40% or less by weight of the fiber matrix (e.g., 35% or less, 30% or less, 25% or less, 20% or less, 15% or less, 10% or less, or 5% or less).

The polysaccharide can be added to the slurry in a concentration ranging from any of the minimum values described above to any of the maximum values described above. For example, in some embodiments, the polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the non-ionizable polysaccharide, cationic polysaccharide, anionic polysaccharide, or any combination thereof can be present in the slurry in a concentration of at least 1% by weight of the fiber matrix (e.g., at least 5%, at least 10%, at least 15%, at least 20%, at least 25%, at least 30%, or at least 35%). In some embodiments, the non-ionizable polysaccharide, cationic polysaccharide, anionic polysaccharide, or any combination thereof can be present in the slurry in a concentration of 40% or less by weight of the fiber matrix (e.g., 35% or less, 30% or less, 25% or less, 20% or less, 15% or less, 10% or less, or 5% or less).

The non-ionizable polysaccharide, cationic polysaccharide, anionic polysaccharide, or any combination thereof can be added to the slurry in a concentration ranging from any of the minimum values described above to any of the maximum values described above. For example, in some embodiments, the polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the cationic polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the cationic polysaccharide can be present in the slurry in a concentration of 40% or less by weight of the fiber matrix (e.g., 35% or less, 30% or less, 25% or less, 20% or less, 15% or less, 10% or less, or 5% or less).

The cationic polysaccharide can be added to the slurry in a concentration ranging from any of the minimum values described above to any of the maximum values described above. For example, in some embodiments, the cationic polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the anionic polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the anionic polysaccharide can be present in the slurry in a concentration of 40% or less by weight of the fiber matrix (e.g., 35% or less, 30% or less, 25% or less, 20% or less, 15% or less, 10% or less, or 5% or less).

The anionic polysaccharide can be added to the slurry in a concentration ranging from any of the minimum values described above to any of the maximum values described above. For example, in some embodiments, the anionic polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, the non-ionizable polysaccharide can be present in the slurry in a concentration of at least 1% by weight of the fiber matrix (e.g., at least 5%, at least 10%, at least 15%, at least 20%, at least 25%, at least 30%, or at least 35%). In some embodiments, the non-ionizable polysaccharide can be present in the slurry in a concentration of 40% or less by weight of the fiber matrix (e.g., 35% or less, 30% or less, 25% or less, 20% or less, 15% or less, 10% or less, or 5% or less).

The non-ionizable polysaccharide can be added to the slurry in a concentration ranging from any of the minimum values described above to any of the maximum values described above. For example, in some embodiments, the non-ionizable polysaccharide can be added in a concentration of from 1% to 40% by weight of the fiber matrix (e.g., from 1% to 5%, from 1% to 10%, from 1% to 15%, from 1% to 20%, from 1% to 30%, from 5% to 40%, from 5% to 30%, from 5% to 20%, from 5% to 15%, from 5% to 10%, from 10% to 40%, from 10% to 30%, from 10% to 20%, from 10% to 15%, from 20% to 30%, from 20% to 40%, or from 30% to 40%).

In some embodiments, when present the fatty acid or salt, ester, amide, derivative thereof, or any combination thereof can be present in the slurry in a concentration of at least 0.1% by weight of the fiber matrix (e.g., at least 0.5%, at least 1%, at least 5%, at least 10%, at least 15%, at least 20%, at least 25%, at least 30%, at least 35%, at least 40%, at least 45%, at least 50%, at least 60%, or at least 70%). In some embodiments, when present the fatty acid or salt, ester, amide, derivative thereof, or any combination thereof can be present in the slurry in a concentration of 80% or less by weight of the fiber matrix (e.g., 70% or less, 60% or less, 50% or less, 45% or less, 40% or less, 35% or less, 30% or less, 25% or less, 20% or less, 15% or less, 10% or less, 5% or less, 1% or less, or 0.5% or less).

When present the fatty acid or salt, ester, amide, derivative thereof, or any combination thereof can be present in the slurry in a concentration ranging from any of the minimum values described above to any of the maximum values described above. For example, in some embodiments, the fatty acid or salt, ester, amide, derivative thereof, or any combination thereof can be present in the slurry in a concentration of from 0.1% to 80% by weight of the fiber matrix (e.g. from 0.1% to 1%, from 0.1% to 5%, from 0.1% to 10%, from 0.1% to 15%, from 0.1% to 20%, from 0.1% to 25%, from 0.1% to 30%, from 0.1% to 35%, from 0.1% to 40%, from 0.1% to 45%, from 0.1% to 50%, from 0.1% to 60%, from 0.1% to 70%, from 0.5% to 1%, from 0.5% to 5%, from 0.5% to 10%, from 0.5% to 15%, from 0.5% to 20%, from 0.5% to 25%, from 0.5% to 30%, from 0.5% to 35%, from 0.5% to 40%, from 0.5% to 45%, from 0.5% to 50%, from 0.5% to 60%, from 0.5% to 70%, from 0.5% to 80%, from 1% to 5%, from 1% to 10%, from 1% to 15%, from 1% to 20%, from 1% to 25%, from 1% to 30%, from 1% to 35%, from 1% to 40%, from 1% to 45%, from 1% to 50%, from 1% to 60%, from 1% to 70%, from 1% to 80%, from 5% to 10%, from 5% to 15%, from 5% to 20%, from 5% to 25%, from 5% to 30%, from 5% to 35%, from 5% to 40%, from 5% to 45%, from 5% to 50%, from 5% to 60%, from 5% to 70%, from 5% to 80%, from 10% to 15%, from 10% to 20%, from 10% to 30%, from 10% to 40%, from 10% to 50%, from 10% to 60%, from 10% to 70%, from 10% to 80%, from 20% to 30%, from 20% to 40%, from 20% to 50%, from 20% to 60%, from 20% to 70%, from 20% to 80%, from 30% to 40%, from 30% to 50%, from 30% to 60%, from 30% to 70%, from 30% to 80%, from 40% to 50%, from 40% to 60%, from 40% to 70%, from 40% to 80%, from 50% to 60%, from 50% to 70%, from 50% to 80%, from 60% to 70%, from 60% to 80%, or from 70% to 80%).

In some embodiments, when present the internal sizing agent can be present in the slurry in a concentration of at least 0.03% by weight of the fiber matrix (e.g., at least 0.1%, at least 0.5%, at least 1%, at least 5%, at least 10%, at least 20%, at least 30%, at least 40%, at least 50%, at least 60%, at least 70%, or at least 80%). In some embodiments, the internal sizing agent can be present in the slurry in a concentration of 90% or less by weight of the slurry (e.g., 80% or less, 70% or less, 60% or less, 50% or less, 40% or less, 30% or less, 20% or less, 10% or less, 5% or less, 1% or less, 0.5% or less, or 0.1% or less).

The internal sizing agent can be present in the slurry in a concentration ranging from any of the minimum values described above to any of the maximum values described above. For example, in some embodiments, the internal sizing agent can be present in the slurry in a concentration of from 0.03% to 90% by weight of the fiber matrix (e.g., from 0.03% to 90%, from 0.03% to 80%, from 0.03% to 70%, from 0.03% to 60%, from 0.03% to 50%, from 0.03% to 40%, from 0.03% to 30%, from 0.03% to 20%, from 0.03% to 10%, from 0.03% to 5%, from 0.03% to 1%, from 1% to 90%, from 1% to 80%, from 1% to 70%, from 1% to 60%, from 1% to 50%, from 1% to 40%, from 1% to 30%, from 1% to 20%, from 1% to 10%, from 1% to 5%, from 5% to 90%, from 5% to 80%, from 5% to 70%, from 5% to 60%, from 5% to 50%, from 5% to 40%, from 5% to 30%, from 5% to 20%, from 5% to 10%, from 10% to 90%, from 10% to 80%, from 10% to 70%, from 10% to 60%, from 10% to 50%, from 10% to 40%, from 10% to 30%, from 10% to 20%, from 20% to 90%, from 20% to 80%, from 20% to 70%, from 20% to 60%, from 20% to 50%, from 20% to 40%, from 20% to 30%, from 30% to 90%, from 30% to 80%, from 30% to 70%, from 30% to 60%, from 30% to 50%, from 30% to 40%, from 40% to 90%, from 40% to 80%, from 40% to 70%, from 40% to 60%, from 40% to 50%, from 50% to 90%, from 50% to 80%, from 50% to 70%, from 50% to 60%, from 60% to 90%, from 60% to 80%, from 60% to 70%, from 70% to 90%, from 70% to 80%, or from 80% to 90%).

In some embodiments, the methods do not include adding a fluorocarbon or a non-compostable synthetic polymer; or adding an oil and grease resistant coating.

In some embodiments, the articles can be oil and water resistant. In some embodiments, the article can be hot water resistant, cold water resistant, hot oil resistant, cold oil resistant, or any combination thereof.

Reference will now be made in detail to specific aspects of the disclosed materials, compounds, compositions, articles, and methods, examples of which are illustrated in the accompanying Examples and Figures.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit, and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

EXEMPLARY EMBODIMENTS

Embodiment 1

A fiber matrix comprising a pulped fiber, one or more polysaccharide, and a fatty acid or salt, ester, amide, derivative thereof, or any combination thereof, an acid, or any combination thereof distributed within the fiber matrix.

Embodiment 2

The fiber matrix of any one of embodiments 1-2, wherein the polysaccharide comprises a cationic polysaccharide comprising chitin, chitosan, partially deacetylated chitin, cationic starch, cationic cellulose, cationic dextran, cationic guar gum, or any combination thereof.

Embodiment 3

The fiber matrix of any one of embodiments 1-2, wherein the polysaccharide comprises an anionic polysaccharide comprising heparin, hyaluronic acid, carrageenan, alginic acid, alginate, chondroitin sulfate, or any combination thereof.

Embodiment 4

The fiber matrix of any one of embodiments 1-2, wherein the polysaccharide comprises a non-ionizable polysaccharide chosen from starch, cellulose, hemicellulose, dextran, guar gum, tera gum, glucomannan, curdlan, or any combination thereof.

Embodiment 5

The fiber matrix of any one of embodiments 1-4, wherein the polysaccharide is present in a concentration of from 1% to 20% by weight of the fiber matrix.

Embodiment 6

The fiber matrix of any one of embodiments 1-5, comprising a fatty acid or salt, ester, amide, derivative thereof, or any combination thereof.

Embodiment 7

The fiber matrix of any one of embodiments 1-6, wherein the fatty acid is chosen from oleic, caprylic acid, pelargonic acid, capric acid, lauric acid, myristic acid, palmitic acid, margaric acid, stearic acid, arachidic acid, behenic acid, lignoceric, cerotic acid, montanic acid, melissic acid, palmitoleic acid, myristoleic acid, linoleic acid, linolenic acid, petroselinic, vaccenic acid, gadolenic acid, cetoleic acid, erucic acid, selacholeic acid, ximenic acid, lumequic acid, and any combination thereof.

Embodiment 8

The fiber matrix of embodiment 7, wherein the fatty acid salt comprises ammonium salts of the fatty acid, sodium salts of the fatty acid, potassium salts of the fatty acid, calcium salts of the fatty acid, zinc salts of the fatty acid, magnesium salts of the fatty acid, iron salts of the fatty acid, manganese salts of the fatty acid, aluminum salts of the fatty acid, or any combination thereof.

Embodiment 9

The fiber matrix of embodiment 6, wherein the fatty acid ester comprises stearyl acetate, stearyl citrate, stearyl palmitate, stearyl stearate, stearyl behenate, or any combination thereof.

Embodiment 10

The fiber matrix of embodiment 6, wherein the fatty acid or salt, ester, amide, derivative thereof, or any combination thereof comprises a zinc stearate, magnesium stearate, aluminum stearate, steric acid, or any combination thereof.

Embodiment 11

The fiber matrix of embodiments 6, wherein the fatty acid amide comprises stearamide, ethylene bis-stearamide, oleamide, ethylene bis-Oleamide, or any combination thereof.

Embodiment 12

The fiber matrix of any one of embodiments 6-11, wherein the fatty acid or salt, ester, amide, derivative thereof, or any combination thereof is present in a concentration of from 0.1% to 50% by weight of the fiber matrix.

Embodiment 13

The fiber matrix of any one of embodiments 1-12, comprising an acid.

Embodiment 14

The fiber matrix of embodiment 1-13, wherein the acid comprises hydrochloric acid, phosphoric acid, sulfuric acid, nitric acid, lactic acid, acetic acid, formic acid, malic acid, propionic acid, adipic acid, glycolic acid, citric acid, oxalic acid, uric acid, tartaric acid, or any combination thereof.

Embodiment 15

The fiber matrix of any one of embodiments 1-14, further comprising an internal sizing agent.

Embodiment 16

The fiber matrix of embodiment 15, wherein the internal sizing agent is an alkyl, alkenyl, aryl, alkaryl ketene dimer, alkenyl succinic anhydride, rosin, wax, stearic anhydride, or other fatty acid anhydride.

Embodiment 17

The fiber matrix of embodiment 18, wherein the internal sizing agent is an alkyl ketene dimer.

Embodiment 18

The fiber matrix of any one of embodiments 15-17, wherein the internal sizing agent is present from 0.03% to 90% by weight of the fiber matrix.

Embodiment 19

The fiber matrix of any one of embodiments 1-17, further comprising a filler material.

Embodiment 20

The fiber matrix of embodiment 19, wherein the filler material comprises a mineral, a lignocellulose particle, or any compostable material useful as a filler, either biodegradable or inorganic, or any combination thereof.

Embodiment 21

The fiber matrix of any one of embodiments 1-20, wherein the pulped fiber comprises a cellulosic fiber.

Embodiment 22

The fiber matrix of any one of embodiments 1-21, comprising a pulped fiber, an acetic acid, and a cationic polysaccharide distributed within the fiber matrix.

Embodiment 23

The fiber matrix of any one of embodiments 1-21, comprising a pulped fiber, an acetic acid, zinc stearate, and a cationic polysaccharide distributed within the fiber matrix.

Embodiment 24

A fiber matrix comprises a pulped fiber, a polysaccharide, an acid, and a fatty acid or salt, ester, amide, derivative thereof, or any combination thereof distributed within the fiber matrix, wherein the sum of the weight percent concentration of all polysaccharides and all fatty acid or salt, ester, amide, derivative thereof, or any combination thereof present in the fiber matrix is from greater than 5% to 55%.

Embodiment 25

A fiber matrix comprising a pulped fiber, a cationic polysaccharide, an acid, and a fatty acid or salt, ester, amide, derivative thereof, or any combination thereof distributed within the fiber matrix.

Embodiment 26

The fiber matrix of any one of embodiments 23-25, further comprising an internal sizing agent, a filler, or any combination thereof.

Embodiment 27

A fiber matrix comprising a pulped fiber and a fatty acid or salt, ester, amide, derivative thereof, or any combination thereof distributed within the fiber matrix.

Embodiment 28

The fiber matrix of embodiment 27, further comprising a polysaccharide, a surfactant, an internal sizing agent, a filler, an acid, or any combination thereof.

Embodiment 29

A fiber matrix comprising a pulped fiber; a polysaccharide, fatty acid, salts, esters, amide, derivative thereof, or any combination thereof; and distributed within the fiber matrix.

Embodiment 30

The fiber matrix of any one of embodiments 24-29, wherein the polysaccharide comprises a non-ionizable polysaccharide, cationic polysaccharide, anionic polysaccharide, or any combination thereof.

Embodiment 31

The fiber matrix of any one of embodiments 23-30, wherein the fatty acid or salt, ester, amide, derivative thereof, or any combination thereof is chosen from oleic, caprylic acid, pelargonic acid, capric acid, lauric acid, myristic acid, palmitic acid, margaric acid, stearic acid, arachidic acid, behenic acid, lignoceric, cerotic acid, montanic acid, melissic acid, palmitoleic acid, myristoleic acid, linoleic acid, linolenic acid, petroselinic, vaccenic acid, gadolenic acid, cetoleic acid, erucic acid, selacholeic acid, ximenic acid, lumequic acid, and any combination thereof.

Embodiment 32

The fiber matrix of embodiment 23-31, wherein the fatty acid salt comprises ammonium salts of the fatty acid, sodium salts of the fatty acid, potassium salts of the fatty acid, calcium salts of the fatty acid, zinc salts of the fatty acid, magnesium salts of the fatty acid, iron salts of the fatty acid, manganese salts of the fatty acid, aluminum salts of the fatty acid, or any combination thereof.

Embodiment 33

The fiber matrix of embodiment 23-31, wherein the fatty acid ester comprises stearyl acetate, stearyl citrate, stearyl palmitate, stearyl stearate, stearyl behenate, or any combination thereof.

Embodiment 34

The fiber matrix of any one of embodiments 23-31, wherein the fatty acid or salt, ester, amide, derivative thereof, or any combination thereof comprises a zinc stearate, magnesium stearate, steric acid, aluminum salts of the fatty acid, or any combination thereof.

Embodiment 35

The fiber matrix of any one of embodiments 23-34, wherein the fatty acid or salt, ester, amide, derivative thereof, or any combination thereof is present in a concentration of from 0.1% to 50% by weight of the fiber matrix.

Embodiment 36

The fiber matrix of any one of embodiments 27-35, comprising a pulped fiber and a zinc stearate distributed within the fiber matrix.

Embodiment 37

The fiber matrix of any one of embodiments 29-36, further comprising a surfactant, an internal sizing agent, a filler, an acid, or any combination thereof.

Embodiment 38

The fiber matrix of any one of embodiments 26, 28, or 37, wherein the internal sizing agent is an alkyl, alkenyl, aryl, alkaryl ketene dimer, alkenyl succinic anhydride, rosin, wax, stearic anhydride, or other fatty acid anhydride.

Embodiment 39

The fiber matrix of embodiment 38, wherein the internal sizing agent is an alkyl ketene dimer.

Embodiment 40

The fiber matrix of any one of embodiments 26, 28, or 37-39, wherein the internal sizing agent is present from 0.03% to 90% by weight of the fiber matrix.

Embodiment 41

The fiber matrix of any one of embodiments 24-26, 28, or 37-40, wherein the acid comprises hydrochloric acid, phosphoric acid, sulfuric acid, nitric acid, lactic acid, acetic acid, formic acid, malic acid, propionic acid, adipic acid, glycolic acid, citric acid, oxalic acid, uric acid, tartaric acid, or any combination thereof.

Embodiment 42

The fiber matrix of any one of embodiments 1-41, wherein the fiber matrix is water and oil resistant when compressed and heated.

Embodiment 43

A method for preparing a fiber matrix, the method comprising:

blending a pulped fiber, a polysaccharide, and optionally a fatty acid or salt, ester, amide, derivative thereof, or any combination thereof, an acid, or any combination thereof, and water to create a slurry;

casting the slurry to a wet mat of product shape; and compressing and heating the wet mat to remove water to form the fiber matrix.

Embodiment 44

A method for preparing a fiber matrix, the method comprising:

blending pulped fiber, polysaccharide, and a fatty acid or salt, ester, amide, derivative thereof, or any combination thereof, an acid, or any combination thereof, and water to create a slurry;

casting the slurry to a wet mat of product shape; and compressing and heating the wet mat to remove water to form the fiber matrix.

Embodiment 45

A method for preparing a fiber matrix, the method comprising:

blending pulped fiber, polysaccharide, a fatty acid or salt, ester, amide, derivative thereof, or any combination thereof, and an acid, and water to create a slurry;

casting the slurry to a wet mat of product shape; and compressing and heating the wet mat to remove water to form the fiber matrix.

Embodiment 46

The method of any one of embodiments 43-45, further comprising blending an internal sizing agent, a filler, or any combination thereof to create the slurry.

Embodiment 47

A method for preparing a fiber matrix, the method comprising:

blending pulped fiber, a fatty acid or salt, ester, amide, derivative thereof, or any combination thereof, and water to create a slurry;

casting the slurry to a wet mat of product shape; and compressing and heating the wet mat to remove water to form the fiber matrix.

Embodiment 48

The method of embodiment 47, further comprising blending an acid, a polysaccharide, internal sizing agent, a filler, a surfactant, or any combination thereof with the pulped fiber, a fatty acid or salt, ester, amide, derivative thereof, or any combination thereof, and water to create a slurry.

Embodiment 49

The method of any one of embodiments 43-48, wherein the polysaccharide comprises a non-ionizable polysaccharide, a cationic polysaccharide, an anionic polysaccharide, or any combination thereof.

Embodiment 50

The method of any one of embodiments 43-49, wherein the fatty acid or salt, ester, amide, derivative thereof, or any combination thereof is chosen from oleic, caprylic acid, pelargonic acid, capric acid, lauric acid, myristic acid, palmitic acid, margaric acid, stearic acid, arachidic acid, behenic acid, lignoceric, cerotic acid, montanic acid, melissic acid, palmitoleic acid, myristoleic acid, linoleic acid, linolenic acid, petroselinic, vaccenic acid, gadolenic acid, cetoleic acid, erucic acid, selacholeic acid, ximenic acid, lumequic acid, and any combination thereof.

Embodiment 51

The method of embodiment 43-50, wherein the fatty acid salt comprise ammonium salts of the fatty acid, sodium salts of the fatty acid, potassium salts of the fatty acid, calcium salts of the fatty acid, zinc salts of the fatty acid, magnesium salts of the fatty acid, iron salts of the fatty acid, manganese salts of the fatty acid, aluminum salts of the fatty acid, or any combination thereof.

Embodiment 52

The method of embodiment 43-50, wherein the fatty acid ester comprises stearyl acetate, stearyl citrate, stearyl palmitate, stearyl stearate, stearyl behenate, or any combination thereof.

Embodiment 53

The method of any one of embodiments 43-50, wherein the fatty acid or salt, ester, amide, derivative thereof, or any combination thereof comprises a zinc stearate, magnesium stearate, aluminum stearate, steric acid, or any combination thereof.

Embodiment 54

The method of any one of embodiments 46 or 48, wherein the internal sizing agent is an alkyl, alkenyl, aryl, alkaryl ketene dimer, alkenyl succinic anhydride, rosin, wax, stearic anhydride, or other fatty acid anhydride.

Embodiment 55

The method of embodiment 54, wherein the internal sizing agent is an alkyl ketene dimer (AKD).

Embodiment 56

The method of any one of embodiments 43-45, or 48-55, wherein the acid comprises hydrochloric acid, phosphoric acid, sulfuric acid, nitric acid, lactic acid, acetic acid, formic acid, malic acid, propionic acid, adipic acid, glycolic acid, citric acid, oxalic acid, uric acid, tartaric acid, or any combination thereof.

Embodiment 57

The method of any one of embodiments 43-45, or 48-56, wherein the acid can be present in the slurry a concentration of from 0.1% to 100% by weight of the polysaccharide.

Embodiment 58

The method of any one of embodiments 44-57, wherein the fiber comprises a cellulosic fiber.

Embodiment 59

The method of any one of embodiments 44-58, wherein blending includes adding a polysaccharide in the form of a granular or insoluble particulate.

Embodiment 60

The method of any one of embodiments 44-59, wherein the method does not comprise adding a fluorocarbon or a non-compostable synthetic polymer; or adding an oil and grease resistant coating.

Embodiment 61

An article of manufacture comprising the fiber matrix of any one of embodiments 1-43.

Embodiment 62

An article of manufacture comprising a fiber matrix comprising a pulped fiber and a polysaccharide distributed within the fiber matrix.

Embodiment 63

The articles of embodiment 62, wherein the polysaccharide comprises a non-ionizable polysaccharide, a cationic polysaccharide, an anionic polysaccharide, or any combination thereof.

Embodiment 64

The article of any one of embodiments 62-63, further comprising a fatty acid or salt, ester, amide, derivative thereof, or any combination thereof, an internal sizing agent, a filler, an acid, a surfactant, or any combination thereof with the pulped fiber, polysaccharide, and water to create the slurry.

Embodiment 65

The article of any one of embodiments 62-64, wherein the fatty acid or salt, ester, amide, derivative thereof, or any combination thereof is chosen from oleic, caprylic acid, pelargonic acid, capric acid, lauric acid, myristic acid, palmitic acid, margaric acid, stearic acid, arachidic acid, behenic acid, lignoceric, cerotic acid, montanic acid, melissic acid, palmitoleic acid, myristoleic acid, linoleic acid, linolenic acid, petroselinic, vaccenic acid, gadolenic acid, cetoleic acid, erucic acid, selacholeic acid, ximenic acid, lumequic acid, and any combination thereof.

Embodiment 66

The articles of any one of embodiments 62-65, wherein the fatty acid salt comprises ammonium salts of the fatty acid, sodium salts of the fatty acid, potassium salts of the fatty acid, calcium salts of the fatty acid, zinc salts of the fatty acid, magnesium salts of the fatty acid, iron salts of the fatty acid, manganese salts of the fatty acid, aluminum salts of the fatty acid, or any combination thereof.

Embodiment 67

The articles of any one of embodiments 62-65, wherein the fatty acid ester comprises stearyl acetate, stearyl citrate, stearyl palmitate, stearyl stearate, stearyl behenate, or any combination thereof.

Embodiment 68

The fiber matrix of any one of embodiments 62-65, wherein the fatty acid or salt, ester, amide, derivative thereof, or any combination thereof comprises a zinc stearate, magnesium stearate, aluminum stearate, steric acid, or any combination thereof.

Embodiment 69

The article of any one of embodiments 62-68, wherein the internal sizing agent is an alkyl, alkenyl, aryl, alkaryl ketene dimer, alkenyl succinic anhydride, rosin, wax, stearic anhydride, or other fatty acid anhydride.

Embodiment 70

The article of embodiment 69; wherein the internal sizing agent is an alkyl ketene dimer (AKD).

Embodiment 71

The article of any one of embodiments 62-70, wherein the acid comprises hydrochloric acid, phosphoric acid, sulfuric acid, nitric acid, lactic acid, acetic acid, formic acid, malic acid, propionic acid, adipic acid, glycolic acid, or any combination thereof.

Embodiment 72

The article of any one of embodiments 62-71, wherein the fiber comprises a cellulosic fiber.

Embodiment 73

The article of manufacture of any one of embodiments 61-72, wherein the article of manufacture is a food container.

Embodiment 74

The article of manufacture of embodiment 73, wherein the food container is a box, a cup, a clamshell, a plate, a bowl, a tray, a carton, an envelope, a sack, a bag, a baggie, a liner, a partition, a wrapper, a film, sheet, or a cushioning material.

Embodiment 75

The article of any one of embodiments 61-74, wherein the article is hot water resistant and cold water resistant.

Embodiment 76

A method of making an article of manufacture, the method comprising:

blending a pulped fiber, a polysaccharide, and optionally a fatty acid or salt, ester, amide, derivative thereof, or any combination thereof, an acid, or any combination thereof, and water to create a slurry;

casting the slurry to a wet mat of product shape; and compressing and heating the wet mat to remove water to form the article.

Embodiment 77

A method of making an article of manufacture, the method comprising:

blending pulped fiber, polysaccharide, and a fatty acid or salt, ester, amide, derivative thereof, or any combination thereof, an acid, or any combination thereof, and water to create a slurry;

casting the slurry to a wet mat of product shape; and compressing and heating the wet mat to remove water to form the article.

Embodiment 78

A method of making an article of manufacture, the method comprising:

blending pulped fiber, polysaccharide, a fatty acid or salt, ester, amide, derivative thereof, or any combination thereof, and an acid, and water to create a slurry;

casting the slurry to a wet mat of product shape; and compressing and heating the wet mat to remove water to form the article.

Embodiment 79

The method of any one of embodiments 76-78, further comprising blending an internal sizing agent, a filler, or any combination thereof to create the slurry.

Embodiment 80

A method for preparing a fiber matrix, the method comprising:

blending pulped fiber, a fatty acid or salt, ester, amide, derivative thereof, or any combination thereof, and water to create a slurry;

casting the slurry to a wet mat of product shape; and compressing and heating the wet mat to remove water to form the fiber matrix.

Embodiment 81

The method of embodiment 80, further comprising blending an acid, a polysaccharide, internal sizing agent, a filler, a surfactant, or any combination thereof with the pulped fiber, a fatty acid or salt, ester, amide, derivative thereof, or any combination thereof, and water to create a slurry.

Embodiment 82

A method of making an article of manufacture comprising:

blending pulped fiber; a polysaccharide; and water to create a slurry;

casting the slurry to a wet mat of product shape; and compressing and heating the wet mat to remove water to form the fiber matrix.

Embodiment 83

The method of embodiment 82, further comprising an acid; a fatty acid or salt, ester, amide, derivative thereof, or any combination thereof; an internal sizing agent, a filler, a surfactant; or any combination thereof.

Embodiment 84

The method of any one of embodiments 76-83, wherein the polysaccharide comprises a non-ionizable polysaccharide, a cationic polysaccharide, an anionic polysaccharide, or any combination thereof.

Embodiment 85

The method of any one of embodiments 76-84, wherein the fatty acid or salt, ester, amide, derivative thereof, or any combination thereof is chosen from oleic, caprylic acid, pelargonic acid, capric acid, lauric acid, myristic acid, palmitic acid, margaric acid, stearic acid, arachidic acid, behenic acid, lignoceric, cerotic acid, montanic acid, melissic acid, palmitoleic acid, myristoleic acid, linoleic acid, linolenic acid, petroselinic, vaccenic acid, gadolenic acid, cetoleic acid, erucic acid, selacholeic acid, ximenic acid, lumequic acid, and any combination thereof.

Embodiment 86

The method of any one of embodiments 76-85, wherein the fatty acid salt comprises ammonium salts of the fatty acid, sodium salts of the fatty acid, potassium salts of the fatty acid, calcium salts of the fatty acid, zinc salts of the fatty acid, magnesium salts of the fatty acid, iron salts of the fatty acid, manganese salts of the fatty acid, aluminum salts of the fatty acid, or any combination thereof.

Embodiment 87

The method of embodiment 76-85, wherein the fatty acid ester comprises stearyl acetate, stearyl citrate, stearyl palmitate, stearyl stearate, stearyl behenate, or any combination thereof.

Embodiment 88

The method of any one of embodiments 76-86, wherein the fatty acid or salt, ester, amide, derivative thereof, or any combination thereof comprises a zinc stearate, magnesium stearate, steric acid, aluminum stearate, or any combination thereof.

Embodiment 89

The method of embodiment 79, 81, or 83-88, wherein the internal sizing agent is an alkyl, alkenyl, aryl, alkaryl ketene dimer, alkenyl succinic anhydride, rosin, wax, stearic anhydride, or other fatty acid anhydride.

Embodiment 90

The method of embodiment 74; wherein the internal sizing agent is an alkyl ketene dimer (AKD).

Embodiment 91

The method of any one of embodiments 76-90, wherein the acid comprises hydrochloric acid, phosphoric acid, sulfuric acid, nitric acid, lactic acid, acetic acid, formic acid, malic acid, propionic acid, adipic acid, glycolic acid, or any combination thereof.

Embodiment 92

The method of any one of embodiments 78-86, wherein the fiber comprises a cellulosic fiber.

Embodiment 93

The method of any one of embodiments 76-92, wherein blending includes adding a polysaccharide in the form of a granular or insoluble particulate.

Embodiment 94

The method of any one of embodiments 76-93, wherein the method does not comprise adding a fluorocarbon or a non-compostable synthetic polymer; or adding an oil and grease resistant coating.

Embodiment 95

The method of any one of embodiments 76-94, wherein the article is oil and water resistant.

Embodiment 96

The method of any one of embodiments 76-95, wherein the article of manufacture is a food container.

Embodiment 97

The method of embodiment 96, wherein the food container is a box, a cup, a clamshell, a plate, a bowl, a tray, a carton, an envelope, a sack, a bag, a baggie, a liner, a partition, a wrapper, a film, sheet, or a cushioning material.

By way of non-limiting illustration, examples of certain embodiments of the present disclosure are given below.

EXAMPLES

The following examples are put forth so as to provide those of ordinary skill in the art with a complete disclosure and description of how the compounds, compositions, articles, devices and/or methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.), but some errors and deviations should be accounted for. Unless indicated otherwise, parts are parts by weight, temperature is in ° C. or is at ambient temperature, and pressure is at or near atmospheric.

Example 1

Preparation of Oil and Water-Resistant Composites Including Polysaccharides and an Acid Chitin/Chitosan materials are heteropolysaccharides composed of N-acetyl glucosamine and D-glucosamine. Solubility of Chitin/Chitosan materials in mild acetic acid depends on the amount of D-glucosamine and distribution of D-glucosamine in the polysaccharides. Chitin subjected to a commercial thermochemical deacetylation process generally yields chitosan with more than 85% D-glucosamine content, and it is soluble in mild acetic acid.

For acid-insoluble chitin, it was soaked in 0.2% acetic acid solution for 18 h. Then, 1.5% chitin pulp was prepared by blending 30 min in a household blender. The resultant chitin slurry has a consistency that of a cream. The chitin pulp was mixed with 12 g fiber and water to obtain 3% pulp slurry. 2.4 g of 15% AKD was added to the fiber/chitin pulp slurry and blended for an additional 30 seconds. The slurry was diluted with water to make 0.5% fiber/chitin slurry. The fiber/chitin slurry was filtered through a 16-20 mesh to remove excess water by gravity filtration. The wet cake is further subjected to a vacuum suction to remove more water. Finally, the fiber/chitin composite was hot pressed at 190° C., 0.4 MPa for 1 minute. Each formulation gave three discs of 4-inch diameter mold. Aliquots of 0.5-1 g 90° C. oil were poured on the surfaces of each sample and recorded the time taken to spot the oil permeation at the bottom. For a practical food packaging application, the molded pulp products need to resist 90° C. oil for at least 2 hours. So, the formulations that achieved this level of oil resistance were recorded as "excellent".

For acid-soluble chitosan, it was dissolved in 1% acetic acid to product 1% chitosan solution. To the chitosan solution, 1% NaOH was gradually added until it reached to pH 9 while stirring. The resultant chitosan gel was strained through a 16-20 mesh strainer. The gel was blended in a household blender together with 12 g pulped fiber and water to obtain 3% pulp slurry. 2.4 g of 15% AKD was added to the fiber/chitosan slurry and blended for an additional 30 seconds. The slurry was diluted with water to make 0.5% fiber/chitosan slurry. The fiber/chitosan slurry was filtered through a 16-20 mesh to remove excess water by gravity filtration. The wet cake is further subjected to a vacuum suction to remove more water. Finally, the fiber/chitosan composite was hot pressed at 190° C., 0.4 MPa for 1 minute. Each formulation gave three discs of 4-inch diameter mold. Aliquots of 0.5-1 g 90° C. oil were poured on the surfaces of each sample and recorded the time taken to spot the oil permeation at the bottom. For a practical food packaging application, the molded pulp products need to resist 90° C. oil for at least 2 hours. So, the formulations that achieved this level of oil resistance were recorded as "excellent".

TABLE 1

Formulations used for making fiber composites with cationic polysaccharide and acetic acid, and oil test results

| Sample | Control | 20CT | 20CTS |
|---|---|---|---|
| Bagasse Fiber (g) | 12 | 12 | 12 |
| Water (g) | 2,400 | 2,400 | 2,400 |
| Chitin/Chitosan materials (g) | 0 | 2.4 | 2.4 |
| Final Wt (g) | 11.23 | 13.32 | 13.17 |
| Weight of polysaccharide in final product (g) | 0 | 2.09 | 1.94 |
| Percentage of polysaccharide in final product (%) | 0 | 15.7 | 14.7 |
| Oil Resistance (90° C. oil test) | <5 min | Excellent | Excellent |

When the amount of chitin/chitosan materials in the molded pulp products was reduced from 15% to 10%, the oil resistance of the molded pulp was significantly reduced. Instead of increasing the amount of chitosan in the product, chitosan can be mixed with other water-soluble polysaccharides to achieve the desired oil resistance as shown in Table 2.

In this example, an anionic polysaccharide (λ-carrageenan) and a neutral polysaccharide (guar gum). The predetermined amounts of 1% chitosan and 1% λ-carrageenan solutions (Table 2) were mixed and left the mixture for 18 h to complete the reaction. The resultant gel was strained with 16-20 mesh screen. The gel was blended in a household blender together with 12 g pulped fiber and water to obtain 3% pulp slurry. 2.4 g of 15% AKD was added to the fiber/chitosan/λ-carrageenan slurry and blended for an additional 30 seconds. The slurry was diluted with water to make 0.5% fiber/chitosan slurry. The fiber/chitosan/λ-carrageenan slurry was filtered through a 16-20 mesh to remove excess water by gravity filtration. The wet cake is further subjected to a vacuum suction to remove more water. Finally, the fiber/chitosan/λ-carrageenan composite was hot pressed at 190° C., 0.4 MPa for 1 minute. Each formulation gave three discs of 4-inch diameter mold. Aliquots of 0.5-1 g 90° C. oil were poured on the surfaces of each sample and recorded the time taken to spot the oil permeation at the bottom. For a practical food packaging application, the molded pulp products need to resist 90° C. oil for at least 2 hours. So, the formulations that achieved this level of oil resistance were recorded as "excellent".

The predetermined amounts of 1% chitosan and 1% guar gum solutions (Table 2) were mixed and precipitated with 1% NaOH until it reached to pH 11 while stirring. The resultant gel was strained with 16-20 mesh screen. The gel was blended in a household blender together with 12 g pulped fiber and water to obtain 3% pulp slurry. 2.4 g of 15% AKD was added to the fiber/chitosan/guar gum slurry and blended for an additional 30 seconds. The slurry was diluted with water to make 0.5% fiber/chitosan/guar gum slurry. The fiber/chitosan/guar gum slurry was filtered through a 16-20 mesh to remove excess water by gravity filtration. The wet cake is further subjected to a vacuum suction to remove more water. Finally, the fiber/chitosan/guar gum composite was hot pressed at 150° C., 0.2 MPa for 3 minutes. Each formulation gave three discs of 4-inch diameter mold. Aliquots of 0.5-1 g 90° C. oil were poured on the surfaces of each sample and recorded the time taken to spot the oil permeation at the bottom. For a practical food packaging application, the molded pulp products need to resist 90° C. oil for at least 2 hours. So, the formulations that achieved this level of oil resistance were recorded as "excellent".

TABLE 2

Formulations used for making fiber composites with polysaccharides and acetic acid, and oil test results

| Sample | Control | 10CTS | CTS/CGN | CTS/GG |
|---|---|---|---|---|
| Bagasse Fiber (g) | 12 | 12 | 12 | 12 |
| Water (g) | 2,400 | 2,400 | 2,400 | 2,400 |
| Chitosan (g) | 0 | 1.2 | 0.8 | 1.2 |
| λ-Carrageenan (g) | 0 | 0 | 1.6 | 0 |
| Guar Gum (g) | 0 | 0 | 0 | 1.2 |
| Final Wt (g) | 11.23 | 12.27 | 12.40 | 12.12 |
| Weight of polysaccharides in final product (g) | 0 | 1.04 | 1.17 | 0.89 |
| Percentage of polysaccharides in final product (%) | 0 | 8.5 | 9.4 | 7.3 |
| Oil Resistance (90° C. oil test) | <5 min | ~30 min | Excellent | Excellent |

The 3% pulp slurry was prepared by mixing 12 g of pulped fiber and water in a household blender. A starch slurry was prepared by blending predetermined amounts of starch powder (as shown in Table 3, below) in 30 g of 0.1% acetic acid solution for 30 seconds and waiting for 5 minutes before adding to the pulp slurry. The pulp slurry was blended again for 30 seconds. 2.4 g of 15% AKD was added to the fiber/cationic starch slurry and blended for an additional 30 seconds. The slurry was diluted with water to make 0.5% fiber/starch slurry. The fiber/starch slurry was filtered through a 16-20 mesh to remove excess water by gravity filtration. The wet cake is further subjected to a vacuum suction to remove more water. Finally, the fiber/starch composite was hot pressed at 190° C., 0.4 MPa for 1 minute. Each formulation gave three discs of 4-inch diameter. Aliquots of 0.5-1 g 90° C. oil were poured on the surfaces of each sample and recorded the time taken to spot the oil permeation at the bottom. For a practical food packaging application, the molded pulp products need to resist 90° C. oil for at least 2 hours. So, the formulations that achieved this level of oil resistance were recorded as "excellent".

The final product with more than 5% starch provides the desired water and oil resistant property depending on the weight and thickness of the molded pulp products. Results demonstrate that at lower starch concentration, excellent oil resistance can be achieved (at least 2 hours with 90° C. hot oil) by varying weights and thickness of finished products.

Example 2

Preparation of Oil and Water-Resistant Composites Including a Fatty Acid or Salt, Ester, Amide, Derivative Thereof, or any Combination Thereof A 3% fiber slurry was prepared by mixing 15 g of fiber and water. The fiber was from Sugarcane Bagasse. The fiber/water mixture was blended for 30 seconds to disperse the fiber. Different concentrations (20% or 10%) of fatty acid or salt, ester, amide, derivative thereof, or any combination thereof (e.g., stearic acid, a zinc stearate, magnesium stearate, calcium stearate, or monostearyl citrate) were mixed with a dispersant and added to the fiber slurry. A cationic polysaccharide (e.g., chitosan, cationic starch, or cationic guar gum) can be used as a dispersant. In the following examples, 0.06% chitosan solution (Table 4) and 5% cationic starch slurry (Table 5) were used as dispersants. The stearate dispersions were added to the pulp slurry and diluted with water to make 0.5% fiber/fatty acid or salt, ester, amide, derivative thereof, or any combination thereof slurry. The fiber/fatty acid or salt, ester, amide, derivative thereof, or any combination thereof slurry was filtered through a 16-20 mesh to remove excess water by gravity filtration, followed by vacuum suction. Finally, the fiber/fatty acid or salt, ester, amide, derivative thereof, or any combination thereof slurry was hot pressed at 190° C., 0.4 MPa for 1 minute. Each formulation gave three discs of 4-inch diameter. Aliquots of 0.5-1 g 90° C. oil were poured on the surfaces of each sample and recorded the time taken to spot the oil permeation at the bottom. For a practical food packaging application, the molded pulp products need to resist 90° C. oil for at least 2 hours. So, the formulations that achieved this level of oil resistance were recorded as "excellent"

TABLE 3

Formulations used for making fiber composites with starch and acetic acid, and oil test results

| Sample | Control | Corn starch | Cationic starch | Sweet potato starch |
|---|---|---|---|---|
| Bagasse Fiber (g) | 12 | 12 | 12 | 12 |
| Water (g) | 2,400 | 2,400 | 2,400 | 2,400 |
| Starch (g) | 0 | 3.6 | 3.6 | 3.6 |
| Final Wt (g) | 11.65 | 14.15 | 14.11 | 14.03 |
| Weight of polysaccharides in final product (g) | 0 | 2.5 | 2.46 | 2.38 |
| Percentage of polysaccharides in final product (%) | 0 | 16.4 | 17.4 | 17.0 |
| Oil Resistance (90° C. oil test) | <5 min | Excellent | Excellent | Excellent |

TABLE 4

Oil resistance of the molded pulp products with stearate salts dispersion (chitosan as dispersant). Oil tests were done by dropping 90° C. oil on the sample. Excellent means at least 2 h without penetration.

| Sample | Control | Zinc Stearate | Calcium Stearate | Magnesium Stearate |
|---|---|---|---|---|
| Bagasse Fiber (g) | 15 | 15 | 15 | 15 |
| Water (g) | 3,000 | 3,000 | 3,000 | 3,000 |
| Stearate (g) | 0 | 3.0 | 3.0 | 3.0 |
| Final Wt (g) | 14.33 | 15.90 | 16.81 | 16.28 |
| Stearate Wt (g) | 0 | 1.57 | 2.48 | 1.95 |
| Stearate (%) | 0 | 9.9 | 14.8 | 12.0 |
| Oil Resistance | <5 min | Excellent | Excellent | Excellent |

TABLE 5

Oil resistance of the molded pulp products with stearate salts dispersion (cationic starch as dispersant) and an acid. Oil tests were done by dropping 90° C. oil on the sample. Excellent means at least 2 h without penetration.

| Sample | Control | Zinc Stearate | Calcium Stearate | Magnesium Stearate | Monostearyl Citrate | Stearic Acid |
|---|---|---|---|---|---|---|
| Bagasse Fiber (g) | 15 | 15 | 15 | 15 | 15 | 15 |
| Water (g) | 3,000 | 3,000 | 3,000 | 3,000 | 3,000 | 3,000 |
| Stearate (g) | 0 | 1.5 | 1.5 | 1.5 | 1.5 | 1.5 |
| Starch (g) | 0.75 | 0.75 | 0.75 | 0.75 | 0.75 | 0.75 |
| Final Wt (g) | 14.55 | 16.05 | 16.18 | 15.88 | 16.14 | 16.53 |
| Additives Wt (g) | 0 | 1.50 | 1.63 | 1.33 | 1.59 | 1.98 |
| Additives (%) | 0 | 9.3 | 10.1 | 8.4 | 9.9 | 12.0 |
| Oil Resistance | <5 min | Excellent | Excellent | Excellent | ~1 h | ~1.5 h |

Results demonstrate excellent oil resistance was achieved (at least 2 hours with 90° C. hot oil) for composition including stearate salts in a concentration of 10% or 20%. Alternatively, similar oil resistance can also be achieved without using acetic acid. (Table 6) In this experiment, 1.2 g of corn starch and 1.2 g magnesium stearate was added sequentially into 3% pulped fiber slurry. Then the fiber/starch/magnesium stearate slurry was filtered through a 16-20 mesh to remove excess water by gravity filtration, followed by vacuum suction. The resulting moist fiber/starch/magnesium stearate composite was hot pressed at 190° C., 0.4 MPa for 1 minute. The formulation gave three discs of 4-inch diameter. Aliquots of 0.5-1 g 90° C. oil were poured on the surfaces of each sample and recorded the time taken to spot the oil permeation at the bottom. For a practical food packaging application, the molded pulp products need to resist 90° C. oil for at least 2 hours. So, the formulations that achieved this level of oil resistance were recorded as "excellent".

TABLE 6

Oil resistance of the molded pulp products with magnesium stearate and corn starch. Oil tests were done by dropping 90° C. oil on the sample. Excellent means at least 2 h without penetration.

| Sample | Control | CRN/MgSt |
|---|---|---|
| Bagasse Fiber (g) | 15 | 15 |
| Water (g) | 3,000 | 3,000 |
| Starch (g) | 0 | 1.2 |
| MgSt (g) | 0 | 1.2 |
| Final Wt (g) | 14.40 | 16.97 |
| Additives Wt (g) | 0 | 2.57 |
| Additives (%) | 0 | 15.1 |
| Oil Resistance (90° C. oil test) | <5 min | Excellent |

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. Further, while only certain representative compositions and method steps disclosed herein are specifically described, other combinations of the compositions and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated.

The compositions and methods of the appended claims are not limited in scope by the specific compositions and methods described herein, which are intended as illustrations of a few aspects of the claims and any compositions and methods that are functionally equivalent are intended to fall within the scope of the claims. Various modifications of the compositions and methods in addition to those shown and described herein are intended to fall within the scope of the appended claims. Further, while only certain representative compositions and method steps disclosed herein are specifically described, other combinations of the compositions and method steps also are intended to fall within the scope of the appended claims, even if not specifically recited. Thus, a combination of steps, elements, components, or constituents may be explicitly mentioned herein; however, other combinations of steps, elements, components, and constituents are included, even though not explicitly stated.

What is claimed is:

1. A method for preparing a fiber matrix, the method comprising:

blending a pulped fiber, a polysaccharide, a fatty acid salt, and optionally an acid, and water to create a slurry;

casting the slurry to a wet mat of product shape; and compressing and heating the wet mat to remove water to form the fiber matrix, wherein the fiber matrix comprises a pulped fiber, one or more polysaccharide, wherein the polysaccharide is present in a concentration of from 1% to 20% by weight of the fiber matrix, and a fatty acid salt, wherein the fatty acid salt is selected from the group consisting of a zinc stearate, magnesium stearate, calcium stearate, iron salts of the fatty acid, manganese salts of the fatty acid, aluminum salts of the fatty acid, and any combination thereof; and optionally an acid distributed within the fiber matrix, wherein the fatty acid salt is present in a concentration of from 2% to 50% by weight of the fiber matrix.

2. The method of claim 1, wherein when present the acid is present in the slurry in a concentration of from 0.1% to 100% by weight of the polysaccharide.

3. A method of making an article of manufacture, the method comprising:

blending a pulped fiber, a polysaccharide, a fatty acid salt, and optionally an acid, and water to create a slurry;

casting the slurry to a wet mat of product shape; and compressing and heating the wet mat to remove water to form the article, wherein the article comprises a fiber matrix comprising a pulped fiber, one or more polysaccharide, wherein the polysaccharide is present in a concentration of from 1% to 20% by weight of the fiber matrix, and a fatty acid salt, wherein the fatty acid salt is selected from the group consisting of a zinc stearate, magnesium stearate, calcium stearate, iron salts of the fatty acid, manganese salts of the fatty acid, aluminum salts of the fatty acid, and any combination thereof; and optionally an acid distributed within the fiber matrix, wherein the fatty acid salt is present in a concentration of from 2% to 50% by weight of the fiber matrix.

4. The method of claim 3, wherein the polysaccharide comprises a cationic polysaccharide, wherein the cationic polysaccharide is selected from the group consisting of chitin, chitosan, partially deacetylated chitin, cationic starch, cationic cellulose, cationic dextran, cationic guar gum, and any combination thereof.

5. The method of claim 3, wherein the fatty acid salt is present in a concentration of from 5% to 50% by weight of the fiber matrix.

6. The method of claim 3, wherein the acid is present.

7. The method of claim 3, wherein the acid is selected from the group consisting of hydrochloric acid, phosphoric acid, sulfuric acid, nitric acid, lactic acid, acetic acid, formic acid, malic acid, propionic acid, adipic acid, glycolic acid, citric acid, oxalic acid, uric acid, tartaric acid, and any combination thereof.

8. The method of claim 3, further comprising an internal sizing agent, a filler, or any combination thereof.

9. The method of claim 8, wherein the internal sizing agent is selected from the group consisting of an alkyl, alkenyl, aryl, alkaryl ketene dimer, alkenyl succinic anhydride, rosin, wax, stearic anhydride, and other fatty acid anhydride.

10. The method of claim 3, wherein the pulped fiber comprises a cellulosic fiber.

11. The method of claim 3, wherein the sum of the weight percent concentration of all polysaccharides and all fatty acid salt present in the fiber matrix is from greater than 5% to 55%.

12. The method of claim 3, wherein the acid is present.

13. The method of claim 12, wherein the acid is selected from the group consisting of hydrochloric acid, phosphoric acid, sulfuric acid, nitric acid, lactic acid, acetic acid, formic acid, malic acid, propionic acid, adipic acid, glycolic acid, citric acid, oxalic acid, uric acid, tartaric acid, and any combination thereof.

14. The method of claim 3, further comprising an internal sizing agent, a filler, or any combination thereof.

15. The method of claim 14, wherein the internal sizing agent is selected from the group consisting of an alkyl, alkenyl, aryl, alkaryl ketene dimer, alkenyl succinic anhydride, rosin, wax, stearic anhydride, and other fatty acid anhydride.

16. The method of claim 3, wherein the pulped fiber comprises a cellulosic fiber.

* * * * *